US009035936B2

(12) United States Patent
Yamamoto et al.

(10) Patent No.: US 9,035,936 B2
(45) **Date of Patent: *May 19, 2015**

(54) LEVEL SHIFTER CIRCUIT, SCANNING CIRCUIT, DISPLAY DEVICE AND ELECTRONIC EQUIPMENT

(71) Applicant: Sony Corporation, Tokyo (JP)

(72) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/529,310

(22) Filed: Oct. 31, 2014

(65) Prior Publication Data

US 2015/0042232 A1 Feb. 12, 2015

Related U.S. Application Data

(63) Continuation of application No. 13/665,296, filed on Oct. 31, 2012, now Pat. No. 8,922,472.

(30) Foreign Application Priority Data

Nov. 11, 2011 (JP) ..... 2011-247141

(51) Int. Cl.
*G09G 3/32* (2006.01)

(52) U.S. Cl.
CPC ..... *G09G 3/3258* (2013.01); *G09G 2310/0289* (2013.01); *G09G 2300/0871* (2013.01)

(58) Field of Classification Search
CPC ..... G09G 3/3225; G09G 3/3266; G09G 2310/0289
USPC ..... 326/62–92; 327/333; 345/98, 100
See application file for complete search history.

(56) References Cited

U.S. PATENT DOCUMENTS 7,683,668 B1 3/2010 Thakur et al.
2003/0160745 A1 8/2003 Osame et al.

FOREIGN PATENT DOCUMENTS

JP 2007-310311 A 11/2007

*Primary Examiner* — Michael Pervan
(74) *Attorney, Agent, or Firm* — Fishman Stewart Yamaguchi PLLC

(57) ABSTRACT

A level shifter circuit, wherein a first and a second transistor circuit are connected serially, a third and a fourth transistor circuit are connected serially; a first input voltage is applied to the second transistor circuit and a second input voltage is applied to the fourth transistor circuit; an input terminal of the first transistor circuit is connected to an output terminal of the third and the fourth transistor circuits, and an input terminal of the third transistor circuit is connected to an output terminal of the first and the second transistor circuits; two transistor circuits of at least one side of two transistor circuits of a first fixed power source side and two transistor circuits of a second fixed power source side are configured of double gate transistors; and the level shifter circuit has a switch element for applying a voltage to a common connection node.

20 Claims, 13 Drawing Sheets

LEVEL SHIFTER CIRCUIT, SCANNING CIRCUIT, DISPLAY DEVICE AND ELECTRONIC EQUIPMENT

CROSS REFERENCES TO RELATED APPLICATIONS

This is a Continuation Application of U.S. patent application Ser. No. 13/665,296, filed on Oct. 31, 2012, which claims priority from Japanese Patent Application No.: 2011-247141 filed with the Japanese Patent Office on Nov. 11, 2011 the entire contents of which being incorporated herein by reference.

BACKGROUND

The present disclosure relates to a level shifter circuit, a scanning circuit, a display device and electronic equipment.

As one flat type (flat panel type) display device, there is a display device which uses a so-called current driving type electro-optic element as a light-emitting unit (a light emitting element) of pixels, where light emitting brightness thereof changes according to a current value flowing in the device. As the current driving type electro-optic element, for example, there is an organic electro luminescence (EL) element in which for example, an EL of an organic material is used and a phenomenon where light emitting occurs when an electric field is applied to an organic thin film is used.

An organic EL display device using the organic EL as the light-emitting unit of the pixels has the following features. That is, since the organic EL may be driven by an applied voltage less than or equal to 10 V, power consumption is low. Since the organic EL is a light emitting element, visibility of the image is high compared to a liquid crystal display device, and since an illumination member such as a backlight is not provided, it may easily be light weight and low profile. Further, since the response speed of the organic EL is very high at several μsec, an afterimage does not occur when displaying a moving image.

The flat type display device represented by the organic EL display device is configured such that pixels are provided in a two dimensional array in a matrix having at least a writing transistor, a retention capacitor, and a driving transistor as well as the electro-optic element (for example, Japanese Unexamined Patent Application Publication No. 2007-310311).

In such a display device, the writing transistor is driven by a control pulse (a scanning pulse) applied from a scanning circuit (a scanning section) via control lines (scanning lines) which are wired for pixel rows and thereby a signal voltage of a video signal supplied via the signal line is written in the pixels. The retention capacitor maintains the signal voltage that the writing transistor has written. The driving transistor drives the electro-optic element according to the signal voltage that the retention capacitor holds.

SUMMARY

However, generally, when the size of the display panel increases, since a load of the control line transmitting the control pulse from the scanning circuit to the writing transistor is large, sharpness of the waveform of the control pulse is reduced due to influence of the load thereof. In order to suppress the influence of the load thereof, it is considered that the size of the transistor configuring an inverter circuit of the final stage of the scanning circuit is increased and the resistance of the inverter circuit is reduced. However, since the scale of the scanning circuit and further the scale of circuits of peripheral circuits including the scanning circuit increase when the size of the transistor is increased, it impedes a frame of the display panel from being narrowed.

Thus, the size of the transistor configuring the inverter circuit of the final stage of the scanning circuit is maintained without change, in other words, it is necessary to reduce the resistance (ON resistance of the transistor configuring the inverter circuit) of the inverter circuit of the final stage without increasing the size of the transistor. Generally, a resistance value of the transistor depends on the size of the transistor and a gate-source voltage. Accordingly, if the size of the transistor configuring the inverter circuit of the final stage does not increase, it is necessary to increase the gate-source voltage of the transistor, that is, to increase amplitude of an input voltage of the inverter circuit of the final stage.

In order to increase the amplitude of the input voltage of the inverter circuit of the final stage, it is necessary to increase a power source voltage applied to a circuit of a preceding stage of the inverter circuit of the final stage to be higher than the input voltage. However, simply, if the power source voltage applied to the circuit of the preceding stage increases, a source-drain voltage applied to the transistor configuring the voltage of the preceding stage increases and exceeds a predetermined source-drain withstand voltage.

Generally, the source-drain withstand voltage of the transistor is smaller (lower) than a gate-source withstand voltage. Accordingly, if the source-drain withstand voltage applied to the transistor configuring the circuit of the preceding stage exceeds a predetermined source-drain withstand voltage of the transistor, reliability of the transistor decreases remarkably.

It is desirable to provide a level shifter circuit which is capable of increasing amplitude of an input voltage of an inverter circuit of the final stage in the scanning circuit while maintaining a source-drain withstand voltage of a transistor configuring a circuit, a scanning circuit using the level shifter circuit, a display device equipped with the scanning circuit, and electronic equipment having the display device.

According to an embodiment of the present disclosure, there is provided a level shifter circuit, wherein a first transistor circuit configured of a first conductive type transistor and a second transistor circuit configured of a second conductive type transistor are connected serially between a first fixed power source and a second fixed power source, and a third transistor circuit configured of the first conductive type transistor and a fourth transistor circuit configured of the second conductive type transistor are connected serially between the first fixed power source and the second fixed power source, wherein a first input voltage is applied to an input terminal of the second transistor circuit and a second input voltage is applied to an input terminal of the fourth transistor circuit, wherein an input terminal of the first transistor circuit is connected to an output terminal of the third and the fourth transistor circuits, and an input terminal of the third transistor circuit is connected to an output terminal of the first and the second transistor circuits, wherein two transistor circuits of at least one side of two transistor circuits of a first fixed power source side and two transistor circuits of a second fixed power source side are configured of double gate transistors, and wherein the level shifter circuit has a switch element for applying a voltage of a third fixed power source to a common connection node of the double gate transistor of two transistor circuits of the power source side of the other side when two transistor circuits of the power source side of one side are in an operating state.

The level shifter circuit of the present disclosure may be used as the circuit of the preceding stage of the inverter circuit of the final stage in the scanning circuit having the inverter circuit of the final stage. Further, the scanning circuit using the level shifter circuit of the present disclosure as the circuit of the preceding stage of the inverter circuit of the final stage may be equipped as the scanning circuit which scans each pixel, in the display device where each pixel is arranged in a matrix or in the solid-state imaging device. Further, the display device having the scanning circuit which uses the level shifter circuit of the present disclosure as the circuit of the preceding stage of the inverter circuit of the final stage may be used as the display section thereof, in the various electronic equipment including the display section.

In the level shifter circuit having the configuration described above, since the first transistor circuit and the second transistor circuit are connected serially between the first fixed power source and the second fixed power source, when the transistor circuit of the power source side of one side, for example, the first transistor circuit is in an operating state, the voltage of the output terminal is the voltage of the first fixed power source. Similarly, since the third transistor circuit and the fourth transistor circuit are connected serially between the first fixed power source and the second fixed power source, when the transistor circuit of the power source side of one side, for example, the third transistor circuit is in an operating state, the voltage of the output terminal is the voltage of the first fixed power source. Accordingly, the voltage of the first fixed power source and the second fixed power source is applied to the second and the fourth transistor circuits.

At this time, the voltage of the third fixed power source is applied to the common connection node of the double gate transistor of two transistor circuits of the power source side of the other side, for example, the second and the fourth transistor circuits by the switch element. Accordingly, the voltage between the first fixed power source and the second fixed power source is not applied but the voltage between the first fixed power source and the third fixed power source and the voltage between the third fixed power source and the second fixed power source are applied between the source and the drain of two transistors configuring the double gate structure.

Here, the voltage between the first fixed power source and the third fixed power source and the voltage between the third fixed power source and the second fixed power source are voltages within the range of the source-drain withstand voltage of each transistor configuring the first to the fourth transistor circuits. Accordingly, the source-drain voltage applied to the transistor is within the range of the withstand voltage thereof and the output voltage having the amplitude larger than the amplitude of the input voltage may be derived.

According to the present disclosure, since the voltage between the source and the drain of the transistor is within the range of the withstand voltage thereof and the output voltage having an amplitude larger than the amplitude of the input voltage may be derived, the amplitude of the input voltage of the inverter circuit of the final stage may be increased in the scanning circuit while the source-drain withstand voltage of the transistor is maintained.

DETAILED DESCRIPTION OF EMBODIMENTS

Figure 1:
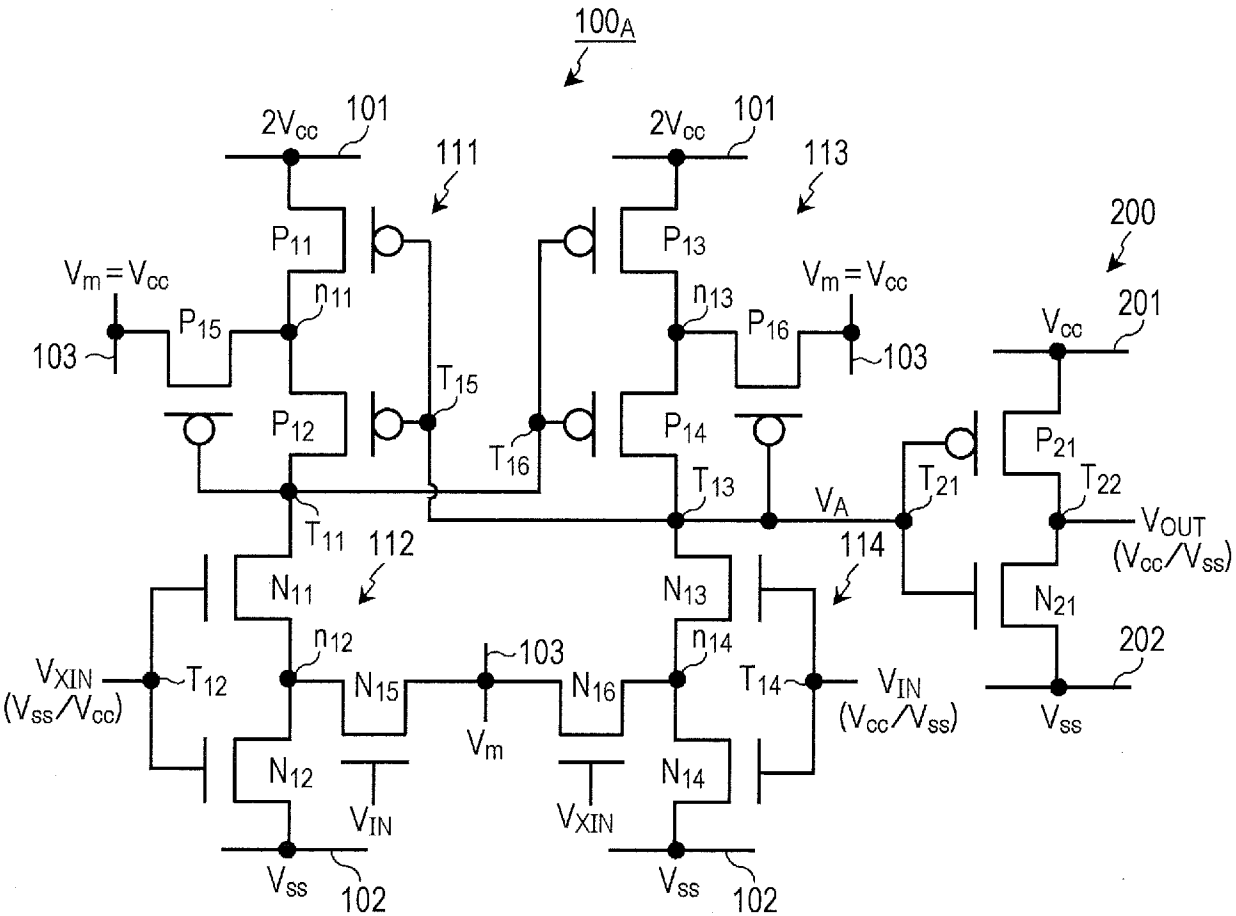
FIG. 1 is a circuit diagram illustrating an example of a configuration of a level shifter circuit according to a first embodiment of the present disclosure.

Hereinafter, modes (hereinafter, referred to as "embodiments") for realizing the technology of the present disclosure are described in detail using the drawings. The present disclosure is not limited to the embodiments. In the description below, the same elements or elements having the same function are given the same reference numerals and repeated description thereof is omitted. In addition, the description is performed in the following order.

1. Description of Entire Level Shifter Circuit of Present Disclosure
2. Level Shifter Circuit According to First Embodiment
2-1. Circuit Configuration
2-2. Circuit Operations
2-3. Actions and Effects
3. Level Shifter Circuit According to Second Embodiment
3-1. Circuit Configuration
3-2. Circuit Operations
3-3. Actions and Effects 4. Level Shifter Circuit According to Third Embodiment
5. Display Device (Organic EL Display Device)
5-1. System Configuration
5-2. Pixel Circuit
5-3. Scanning Circuit
5-4. Others
6. Electronic Equipment
7. Configuration of Present Disclosure 1. Description of Entire Level Shifter Circuit of Present Disclosure The level shifter circuit of the present disclosure has first and third transistor circuits configured of a first conductive type transistor, and second and fourth transistor circuits configured of a second conductive type transistor. The first transistor circuit and the second transistor circuit are connected serially between a first fixed power source and a second fixed power source. The third transistor circuit and the fourth transistor circuit are connected serially between the first fixed power source and the second fixed power source.

A common connection node of the first transistor circuit and the second transistor circuit is an output terminal of these transistor circuits. Further, a common connection node of the third transistor circuit and the fourth transistor circuit is an output terminal of these transistor circuits. Thus, a first input voltage is applied to the input terminal of the second transistor circuit and a second input voltage is applied to the input terminal of the fourth transistor circuit. The first input voltage and the second input voltage may be a reverse phased voltage. The input terminal of the first transistor circuit is connected to the common connection node of the third and the fourth transistor circuits, and the input terminal of the third transistor circuit is connected to the common connection node of the first and the second transistor circuits.

Thus, at least two transistor circuits of one side of two transistor circuits of the first fixed power source side and two transistor circuits of the second fixed power source side are configured of the transistor having a double gate structure, that is, a double gate transistor. Here, two transistor circuits of the first fixed power source side are the first and the third transistor circuits, and two transistor circuits of the second fixed power source side are the second and the fourth transistor circuits.

The transistor circuits of the present disclosure may adopt two circuit forms. A first circuit form is that the first fixed power source is a positive side power source, the second fixed power source is a negative side power source, the first conductive type transistor is a P channel type transistor, and the second conductive type transistor is an N channel type transistor. A second circuit form is that the first fixed power source is the negative side power source, the second fixed power source is the positive side power source, the first conductive type transistor is the N channel type transistor, and the second conductive type transistor is the P channel type transistor.

When the first circuit form is employed, it is preferable that the voltage of the first fixed power source be set to be higher than the voltage of the high voltage side of the first and the second input voltage, and the voltage of the second fixed power source be set to be lower than or equal to the voltage of the low voltage side of the first and the second input voltages. In addition, when the second circuit form is employed, it is preferable that the voltage of the first fixed power source be set to be lower than the voltage of the low voltage side of the first and the second input voltages, and the voltage of the second fixed power source be set to be higher than or equal to the voltage of the high voltage side of the first and the second input voltages.

The level shifter circuit of the present disclosure may be used by assembling with the inverter circuit of the final stage connected to the common connection node of the third and fourth transistor circuits. In this case, in the first circuit form, it is preferable that the voltage of the first fixed power source be set to be higher than the voltage of the positive side power source of the inverter circuit of the final stage, and the voltage of the second fixed power source be set to be lower than or equal to the voltage of the negative side power source of the inverter circuit of the final stage. Further, in the second circuit form, it is preferable that the voltage of the first fixed power source be set to be lower than the voltage of the negative side power source of the inverter circuit of the final stage, and the voltage of the second fixed power source be set to be higher than or equal to the voltage of the positive side power source of the inverter circuit of the final stage.

Thus, the level shifter circuit of the present disclosure has a switch element applying the voltage of a third fixed power source to the common connection node of the double gate transistors of two transistor circuits of the power source side of the other side, when two transistor circuits of the power source of one side are in an operating state.

It is preferable that the voltage of the third fixed power source be a value between voltages of the first and the second fixed power supplies and more favorably be an average value of each voltage of the first and the second fixed power supplies. The switch element selectively applying the voltage of the third fixed power source may be the same conductive type transistor as the transistor configuring two transistor circuits of the power source side of the other side. The same conductive type transistor has the first input voltage or the second input voltage as a gate input.

It is preferable that the voltage between the first fixed power source and the third fixed power source, and the voltage between the third fixed power source and the second fixed power source be voltages within a range of a source-drain withstand voltage of each transistor configuring the first to the fourth transistor circuits. The voltage setting described above is performed and then the source-drain voltage applied to each transistor configuring the first to the fourth transistor circuits may be within a range of the withstand voltage thereof, and an output voltage having amplitude larger than the amplitude of the first and the second input voltages may be derived.

The level shifter circuit of the present disclosure is not limited in its use and may be used in various kinds of uses as a general level shifter circuit. As an example, the level shifter circuit of the present disclosure has the inverter circuit of the final stage and may be used as the circuit of a preceding stage of the inverter circuit of the final stage in the scanning circuit which outputs the scanning signal scanning the pixels arranged in a matrix.

In addition, the scanning circuit using the level shifter circuit of the present disclosure as the circuit of the preceding stage of the inverter circuit of the final stage may be used as the scanning circuit scanning each pixel in the display device in which the pixels including an electro-optic element are arranged in a matrix or in a solid-state imaging device in which the pixels including a photoelectric transformation element are arranged in a matrix. In this case, the scanning circuit may be a form in which the scanning circuit is equipped on the display panel or may be a form in which the scanning circuit is arranged on a location except the display panel as a driver IC. Further, the display device having the scanning circuit using the level shifter circuit of the present disclosure as the circuit of the preceding stage of the inverter circuit of the final stage may be used as the display section in various electronic equipment, including the display section.

Hereinafter, the level shifter circuit of the specific embodiment according to the present disclosure is described.

2. First Embodiment 2-1. Circuit Configuration

FIG. 1 is a circuit diagram illustrating an example of a configuration of the level shifter circuit according to the first embodiment of the present disclosure. A level shifter circuit $\mathbf{100}_A$ according to the first embodiment employs the first circuit form described above. That is, the first fixed power source 101 is the positive side power source, the second fixed power source 102 is the negative side power source, and thereby the P channel type transistor (hereinbelow referred to as "P channel transistor") is used as a first conductive type transistor and the N channel type transistor (hereinbelow referred to as "N channel transistor") is used as a second conductive type transistor.

In FIG. 1, the level shifter circuit $\mathbf{100}_A$ according to the first embodiment is configured of four transistor circuits of a first transistor circuit 111, a second transistor circuit 112, a third transistor circuit 113 and a fourth transistor circuit 114. The first transistor circuit 111 and the second transistor circuit 112 are connected serially between the first fixed power source 101 that is the positive side power source and the second fixed power source 102 that is the negative side power source. Similarly, the third transistor circuit 113 and the fourth transistor circuit 114 are connected serially between the first fixed power source 101 and the second fixed power source 102.

Two transistor circuits of the first fixed power source 101 side, that is, the first transistor circuit 111 and the third transistor circuit 113 are configured of the P channel transistor. Two transistor circuits of the second fixed power source 102 side, that is, the second transistor circuit 112 and the fourth transistor circuit 114 are configured of the N channel transistor. Thus, two transistor circuits 111 and 113 of the first fixed power source 101 side and two transistor circuits 112 and 114 of the second fixed power source 102 side are together configured of the transistor having the double gate structure, that is, the double gate transistor.

However, this is merely an example, and only two transistor circuits of one side of two transistor circuits 111 and 113 of the first fixed power source 101 side and two transistor circuits 112 and 114 of the second fixed power source 102 side may employ the configuration that is configured of the double gate transistor. As described above, when only two transistor circuits of one side are configured of the double gate transistors, two transistor circuits of the other side are configured of a single gate transistors.

The first transistor circuit 111 is configured of two P channel transistors $P_{11}$ and $P_{12}$ having the double gate structure where respective gate electrodes are connected in common. The source electrode of the P channel transistor $P_{11}$ is connected to the first fixed power source 101. The drain electrode of the P channel transistor $P_{11}$ and the source electrode of the P channel transistor $P_{12}$ are connected in common and thereby become a common connection node $n_{11}$ of the double gate transistors ($P_{11}$ and $P_{12}$). The drain electrode of the P channel transistor $P_{12}$ is an output terminal $T_{11}$ of the first transistor circuit 111.

The second transistor circuit 112 is configured of the two N channel transistors $N_{11}$ and $N_{12}$ having the double gate structure where the respective gate electrodes are connected in common. The drain electrode of the N channel transistor $N_{11}$ is the output terminal $T_{11}$ of the second transistor circuit 112. The output terminal $T_{11}$ of the second transistor circuit 112 is also the output terminal $T_{11}$ of the first transistor circuit 111. In other words, the drain electrode of the P channel transistor $P_{12}$ and the drain electrode of the N channel transistor $N_{11}$ are connected in common and thereby become the output terminal $T_{11}$ of the first and second transistor circuits 111 and 112.

The gate electrode connected in common to two N channel transistors $N_{11}$ and $N_{12}$ is the input terminal $T_{12}$ of the second transistor circuit 112. The source electrode of the N channel transistor $N_{11}$ and the drain electrode of the N channel transistor $N_{12}$ are connected in common and thereby become the common connection node $n_{12}$ of the double gate transistors ($P_{11}$ and $P_{12}$). The source electrode of the N channel transistor $N_{12}$ is connected to the second fixed power source 102.

The third transistor circuit 113 is configured of two P channel transistors $P_{13}$ and $P_{14}$ having the double gate structure where the respective gate electrodes are connected in common together. The source electrode of the P channel transistor $P_{13}$ is connected to the first fixed power source 101. The drain electrode of the P channel transistor $P_{13}$ and the source electrode of the P channel transistor $P_{14}$ are connected in common and thereby become the common connection node $n_{13}$ of the double gate transistors ($P_{13}$ and $P_{14}$). The drain electrode of the P channel transistor $P_{14}$ is the output terminal $T_{13}$ of the third transistor circuit 113.

The fourth transistor circuit 114 is configured of two N channel transistors $N_{13}$ and $N_{14}$ having the double gate structure where the respective gate electrodes are connected in common together. The drain electrode of the N channel transistor $N_{13}$ is the output terminal $T_{13}$ of the fourth transistor circuit 114. The output terminal $T_{13}$ of the fourth transistor circuit 114 is also the output terminal $T_{13}$ of the third transistor circuit 113. In other words, the drain electrode of the P channel transistor $P_{14}$ and the drain electrode of the N channel transistor $N_{13}$ are connected in common and thereby become the output terminal $T_{13}$ of the third and the fourth transistor circuits 113 and 114. Further, the output terminal $T_{13}$ of the third and the fourth transistor circuits 113 and 114 is also the output terminal of the present level shifter circuit $\mathbf{100}_A$.

The gate electrode connected in common to two N channel transistors $N_{13}$ and $N_{14}$ is the input terminal $T_{14}$ of the fourth transistor circuit 114. The source electrode of the N channel transistor $N_{13}$ and the drain electrode of the N channel transistor $N_{14}$ are connected in common and thereby become the common connection node $n_{14}$ of the double gate transistors ($N_{13}$ and $N_{14}$). The source electrode of the N channel transistor $N_{14}$ is connected to the second fixed power source 102.

In the level shifter circuit $\mathbf{100}_A$ having the configuration described above, the first and the second input voltages $V_{XIN}$ and $V_{IN}$ are applied to two transistor circuits of the second fixed power source 102 side, that is, to each of the input ends $T_{12}$ and $T_{14}$ of the second and the fourth transistors 112 and 114. The first and the second input voltages $V_{XIN}$ and $V_{IN}$ are reverse phased voltages to each other in which the voltage (the high level) of the high voltage side is $V_{cc}$ and the voltage (the low level) of the low voltage side is $V_{ss}$.

With respect to the first and the second input voltages $V_{XIN}$ and $V_{IN}$, The voltage of the first fixed power source 101 is set to be a voltage higher than the voltage $V_{cc}$ of the high voltage side, for example, to be $2V_{cc}$ and the voltage of the second fixed power source 102 is set to be less than or equal to the voltage V, of the low voltage side, for example, to be the same voltage. Further, the source-drain withstand voltage of each transistor configuring the level shifter circuit $\mathbf{100}_A$, that is, the first to the fourth transistor circuits 111 to 114 is considered to be ($V_{cc}$–$V_{ss}$).

The input terminal $T_{15}$ of the first transistor circuit 111, that is, the gate electrode of the double gate transistors ($P_{11}$ and P12) is connected to the output terminal $T_{13}$ of the third and the fourth transistor circuits 113 and 114. In addition, an input terminal $T_{16}$ of the third transistor circuit 113, that is, the gate electrode of the double gate transistor ($P_{13}$ and $P_{14}$) is connected to the output terminal $T_{11}$ of the first and second transistor circuits 111 and 112.

As described above, the level shifter circuit $\mathbf{100}_A$ according to the present embodiment has the following characteristics in addition to the characteristics in which four transistor circuits of the first transistor circuit 111, the second transistor circuit 112, the third transistor circuit 113 and the fourth transistor circuit 114 are configured of the double gate transistors.

The switch element, for example, the P channel transistor $P_{15}$ that is the same conductive type as the transistor configuring the first transistor circuit 111 is connected between the common connection node $n_{11}$ of the double gate transistors ($P_{11}$ and $P_{12}$) configuring the first transistor circuit 111 and the third fixed power source 103. The P channel transistor $P_{15}$ is configured such that the source/drain electrode of one side is connected to the common connection node $n_{11}$ of the double gate transistors ($P_{11}$ and $P_{12}$) and the source/drain electrode of the other side is connected to the third fixed power source 103.

The P channel transistor $P_{15}$ is configured such that the gate electrode is connected to the output terminal $T_{11}$ of the first and the second switch circuits 111 and 112. Thus, the P channel transistor $P_{15}$ is in a conductive (ON) state and then the voltage $V_m$ of the third fixed power source 103 is applied to the common connection node $n_{11}$ of the double gate transistors ($P_{11}$ and $P_{12}$) of the first transistor circuit 111 when the second transistor circuit 112 is in the operating state. Here, "when the second transistor circuit 112 is in the operating state" is when the N channel transistors $N_{11}$ and $N_{12}$ configuring the second transistor circuit 112 are in a conductive state.

The switch element, for example, the N channel transistor $N_{15}$ that is the same conductive type as the transistor configuring the second transistor circuit 112 is connected between the common connection node $n_{12}$ of the double gate transistors ($N_{11}$ and $N_{12}$) configuring the second transistor circuit 112 and the third fixed power source 103. The N channel transistor $N_{15}$ is configured such that the source/drain electrode of one side is connected to the common connection node $n_{12}$ of the double gate transistors ($N_{11}$ and $N_{12}$) and the source/drain electrode of the other side is connected to the third fixed power source 103.

The N channel transistor $N_{15}$ is configured such that the second input voltage $V_{IN}$ is applied to the gate electrode. Thus, the N channel transistor $N_{15}$ is in a conductive state and then the voltage $V_m$ of the third fixed power source 103 is applied to the common connection node $n_{12}$ of the double gate transistors ($N_{11}$ and $N_{12}$) of the second transistor circuit 112 when the first transistor circuit 111 is in the operating state. Here, "when the first transistor circuit 111 is in the operating state" is when the P channel transistors $P_{11}$ and $P_{12}$ configuring the first transistor circuit 111 are in the conductive state.

The switch element, for example, the P channel transistor $P_{16}$ that is the same conductive type as the transistor configuring the third transistor circuit 113 is connected between the common connection node $n_{13}$ of the double gate transistors ($P_{13}$ and $P_{14}$) configuring the third transistor circuit 113 and the third fixed power source 103. The P channel transistor $P_{16}$ is configured such that the source/drain electrode of one side is connected to the common connection node $n_{13}$ of the double gate transistors ($P_{13}$ and $P_{14}$) and the source/drain electrode of the other side is connected to the third fixed power source 103.

The P channel transistor $P_{16}$ is connected to the output terminal $T_{13}$ of the third and the fourth switch circuits 113 and 114. Thus, the P channel transistor $P_{16}$ is in a conductive state and then the voltage $V_m$ of the third fixed power source 103 is applied to the common connection node $n_{13}$ of the double gate transistors ($P_{13}$ and $P_{14}$) of the third transistor circuit 113 when the fourth transistor circuit 114 is in the operating state. Here, "when the fourth transistor circuit 114 is in the operating state" is when the N channel transistors $N_{13}$ and $N_{14}$ configuring the fourth transistor circuit 114 are in the conductive state.

The switch element, for example, the N channel transistor $N_{16}$ that is the same conductive type as the transistor configuring the fourth transistor circuit 114 is connected between the common connection node $n_{14}$ of the double gate transistors ($N_{13}$ and $N_{14}$) configuring the fourth transistor circuit 114 and the third fixed power source 103. The N channel transistor $N_{16}$ is configured such that the source/drain electrode of one side is connected to the common connection node $n_{14}$ of the double gate transistors ($N_{13}$ and $N_{14}$) and the source/drain electrode of the other side is connected to the third fixed power source 103.

The N channel transistor $N_{16}$ is configured such that the first input voltage $V_{XIN}$ is applied to the gate electrode. Thus, the N channel transistor $N_{16}$ is in a conductive state and then the voltage $V_m$ of the third fixed power source 103 is applied to the common connection node $n_{14}$ of the double gate transistors ($N_{13}$ and $N_{14}$) of the fourth transistor circuit 114 when the third transistor circuit 113 is in the operating state. Here, "when the third transistor circuit 113 is in the operating state" is when the P channel transistors $P_{13}$ and $P_{14}$ configuring the third transistor circuit 113 are in the conductive state.

Here, as the voltage $V_m$ of the third fixed power source 103, the value between voltages of the first and the second fixed power supplies 101 and 102, the average value of each voltage $2V_{cc}$ and $V_{ss}$ of the first and the second fixed power supplies 101 and 102 is favorably used. In the case of the present example, $V_m=V_{cc}$. Further, the voltage between the first fixed power source 101 and the third fixed power source 103, and the voltage between the third fixed power source 103 and the second fixed power source 102 are voltages within a range of the source-drain withstand voltage ($V_{cc}$-$V_{ss}$) of each transistor configuring the first to fourth transistor circuits 111 to 114.

It is preferable that the level shifter circuit $\mathbf{100}_A$ of the configuration described above be used by assembling with the inverter circuit 200 of the final stage where the input terminal is connected to the output terminal $T_{13}$ thereof, that is, the output terminal $T_{13}$ of the third and the fourth transistor circuits 113 and 114. The inverter circuit 200 of the final stage is a CMOS inverter circuit configuration that is configured of the P channel transistor $P_{21}$ and the N channel transistor $N_{21}$. In other words, the P channel transistor $P_{21}$ and the N channel transistor $N_{21}$ are connected serially between the positive side power source 201 and the negative side power source 202.

Thus, in the case of the present example, the voltage of the positive side power source 201 is set to be the same voltage $V_{cc}$ as the high voltage side of the input voltages $V_{IN}$ and $V_{XIN}$ and the voltage of the negative side power source 202 is set to be the same voltage V, as the low voltage side of the input voltages $V_{IN}$ and $V_{XIN}$ respectively. Accordingly, the voltage $2V_{cc}$ of the first fixed power source 101 of the level shifter circuit $\mathbf{100}_A$ of the preceding stage is higher than the voltage $V_{cc}$ of the positive side power source 201 of the inverter circuit 200 of the final stage, and the voltage V, of the second fixed power source 102 is the same as the voltage V, of the negative side power source 102 of the inverter circuit 200 of the final stage.

The respective gate electrodes of the P channel transistor $P_{21}$ and the N channel transistor $N_{21}$ are connected in common together and then are the input terminal $T_{21}$ of the present inverter circuit 200, and are connected to the output terminal $T_{13}$ of the level shifter circuit $\mathbf{100}_A$ of the preceding stage. Further, the respective drain electrodes of the P channel transistor $P_{21}$ and the N channel transistor $N_{21}$ are connected in common together and then are the output terminal $T_{22}$ of the inverter circuit 200. Thus, of which amplitude is $V_{cc}-V_{ss}$, the output voltage $V_{OUT}$, is derived from the output terminal $T_{22}$, where the high voltage side is $V_{cc}$ and the low voltage side is $V_{ss}$.

2-2. Circuit Operations

Subsequently, the circuit operation of the level shifter circuit $\mathbf{100}_A$ according to the first embodiment of the configuration above is described using FIGS. 2 and 3. Each waveform of two input voltages $V_{IN}$ and $V_{XIN}$ which are reverse phased to each other, the output voltage $V_A$ of the level shifter circuit $\mathbf{100}_A$, and the output voltage $V_{OUT}$ of the inverter circuit 200 of the final stage is illustrated in FIG. 4.

Figure 2:
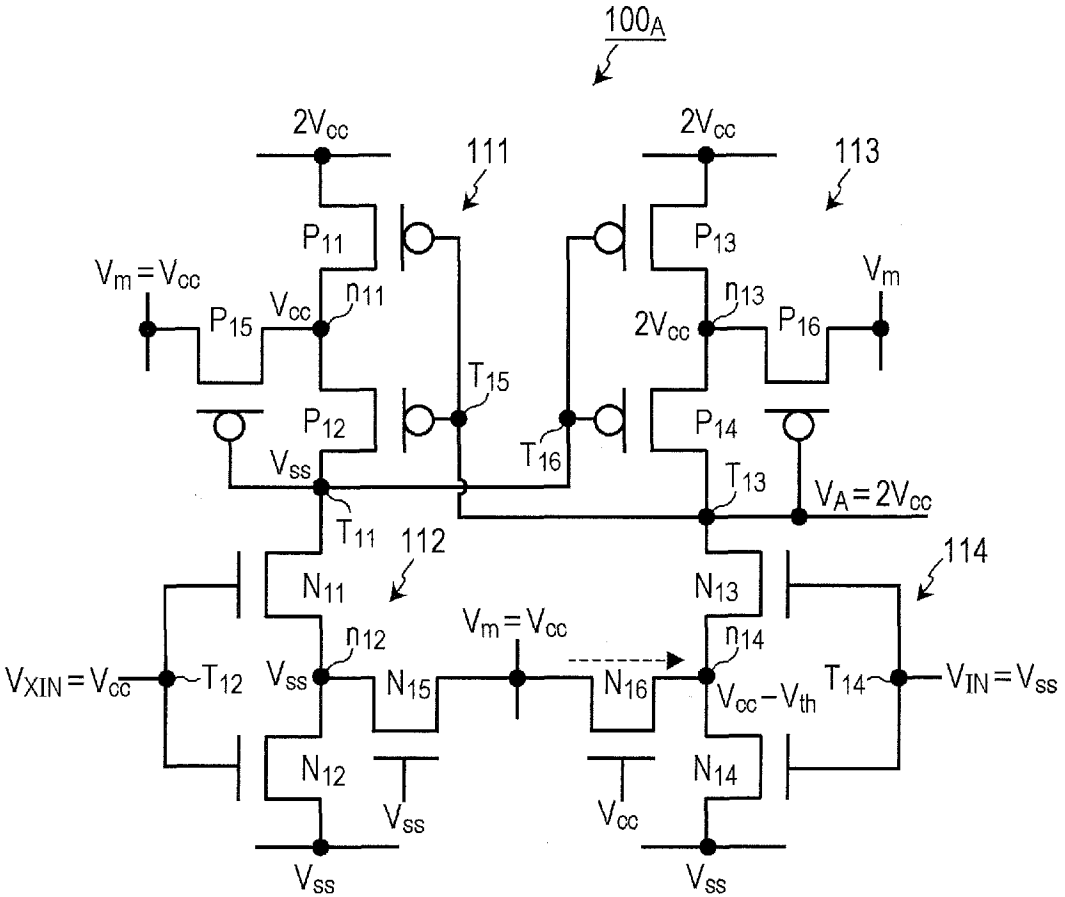
FIG. 2 is an operation illustrative view providing a description of a circuit operation of the level shifter circuit according to the first embodiment when an input voltage $V_{IN}$ of one side is a low level $V_{ss}$ and an input voltage $V_{XIN}$ of the other side is a high level $V_{cc}$.

First, the circuit operation is described using the operation illustrative view of FIG. 2 when the input voltage $V_{IN}$ of one side is the low voltage (the low level) $V_{ss}$ and the input voltage $V_{XIN}$ of the other side is the high voltage (the high level) $V_{cc}$.

When the input voltage $V_{IN}$ of one side is the low level $V_{ss}$ and the input voltage $V_{XIN}$ of the other side is the high level $V_{cc}$, the N channel transistors $N_{11}$ and $N_{12}$ of the second transistor circuit 112 and the N channel transistor $N_{16}$ of the fourth transistor circuit 114 side are in the conductive (ON) state. Accordingly, each gate electric potential of the P channel transistors $P_{13}$ and $P_{14}$ of the third transistor circuit 113, and the P channel transistor $P_{15}$ of the first transistor circuit 111 side is the low level $V_{ss}$.

According to the operation, since the P channel transistors $P_{13}$ and $P_{14}$ of the third transistor circuit 113, and the P channel transistor $P_{15}$ of the first transistor circuit 111 side are in the conductive state, the output voltage $V_A$ of the present level shifter circuit $\mathbf{100}_A$ is the voltage $2V_{cc}$ of the first fixed power source 101. At this time, since $V_m=V_{cc}$, the electric potential of the common connection node $n_{11}$ of the double gate transistors ($P_{11}$ and $P_{12}$) of the first transistor circuit 111 is $V_{cc}$. Further, when a threshold voltage of the N channel transistor $N_{16}$ is $V_{th}$, the electric potential of the common connection node $n_{14}$ of the double gate transistors ($N_{13}$ and $N_{14}$) of the fourth transistor circuit 114 is a value of $V_{cc}-V_{th}$.

Figure 3:
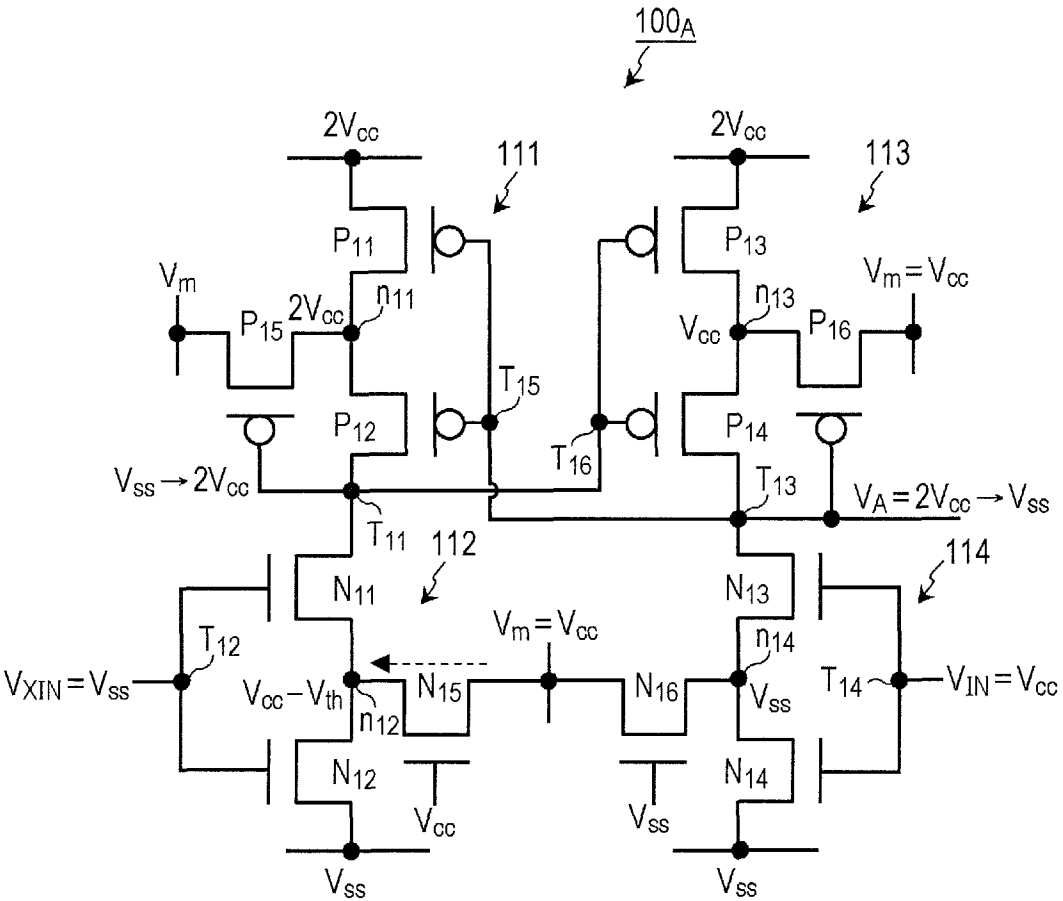
FIG. 3 is an operation illustrative view providing a description of a circuit operation of the level shifter circuit according to the first embodiment when the input voltage $V_{IN}$ of one side is a high level $V_{cc}$ and the input voltage $V_{XIN}$ of the other side is a low level $V_{ss}$.
Figure 4:
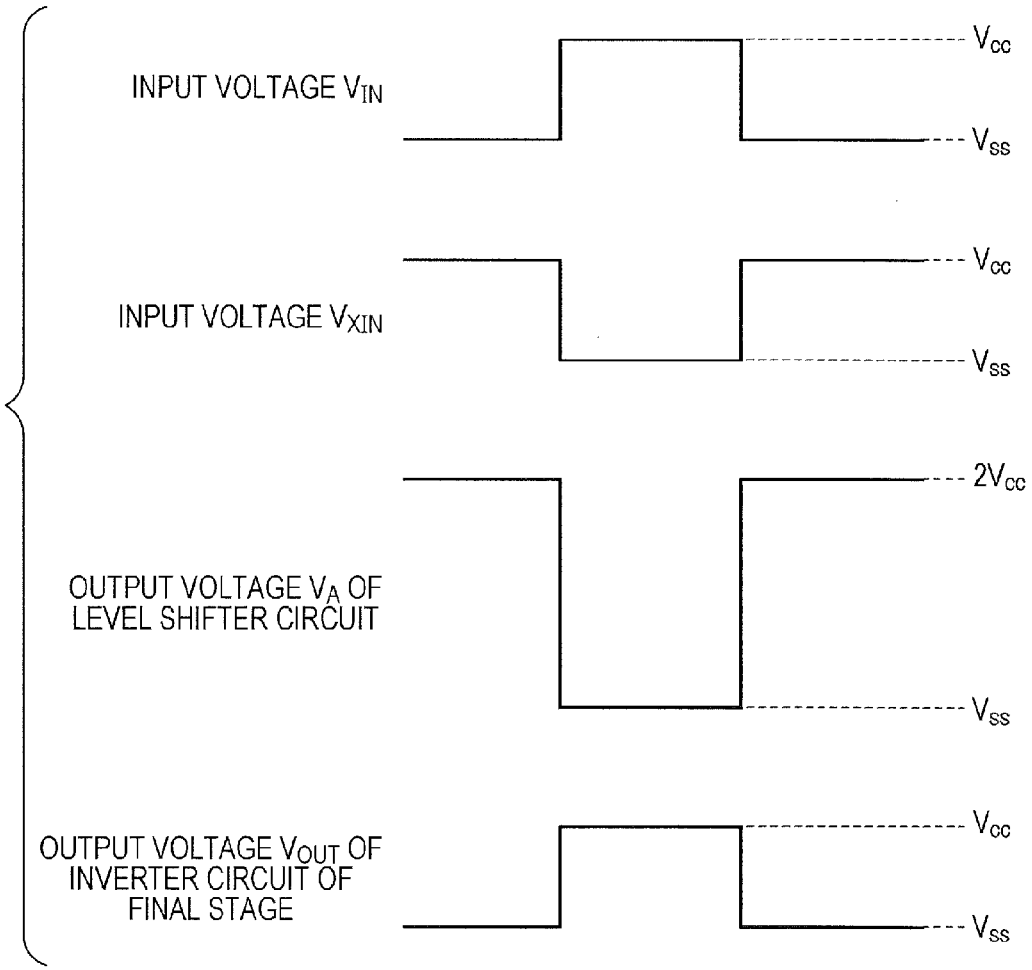
FIG. 4 is a waveform diagram illustrating each waveform of two input voltages $V_{IN}$ and $V_{XIN}$ in the level shifter circuit, an output voltage $V_A$ of the level shifter circuit, and an output voltage $V_{OUT}$ of an inverter circuit of the final stage of the level shifter circuit according to the first embodiment.

Next, the circuit operation is described using the operation illustrative view of FIG. 3 when the input voltage $V_{IN}$ of one side is the high level $V_{cc}$ and the input voltage $V_{XIN}$ of the other side is the low level $V_{ss}$.

When the input voltage $V_{IN}$ of one side is the high level $V_{cc}$ and the input voltage $V_{XIN}$ of the other side is the low level $V_{ss}$, the N channel transistors $N_{13}$ and $N_{14}$ of the fourth transistor circuit 114 and the N channel transistor $N_{15}$ of the second transistor circuit 112 side are in the conductive state. Accordingly, each gate electric potential (this is also the output voltage of the present level shifter circuit $\mathbf{100}_A$) $V_A$ of the P channel transistors $P_{11}$ and $P_{12}$ of the first transistor circuit 111 and the P channel transistor $P_{16}$ of the third transistor circuit 113 side is transitioned from the voltage $2V_{cc}$ of the first fixed power source 101 to the voltage $V_{ss}$ of the second fixed power source 102.

The gate electric potential of the P channel transistors $P_{11}$ and $P_{12}$ of the first transistor circuit 111 is the low level $V_{ss}$, and then the P channel transistors $P_{11}$ and $P_{12}$ are in the conductive state. Accordingly, since the gate electric potential of the P channel transistors $P_{13}$ and $P_{14}$ of the third transistor circuit 113 is the voltage $2V_{cc}$ of the first fixed power source 101, the P channel transistors $P_{13}$ and $P_{14}$ are in the non-conductive (OFF) state. At this time, the electric potential of the common connection node $n_{13}$ of the double gate transistors ($P_{13}$ and $P_{14}$) of the third transistor circuit 113 is $V_{cc}$. Further, when the threshold voltage of the N channel transistor $N_{15}$ is $V_{th}$, the electric potential of the common connection node $n_{12}$ of the double gate transistors ($N_{11}$ and $N_{12}$) of the second transistor circuit 112 is $V_{cc}-V_{th}$.

Here, the source-drain voltage of each transistor configuring the present level shifter circuit $\mathbf{100}_A$ is considered. The source-drain voltage applied to each transistor is determined by each value of the voltage $2V_{cc}$ of the first fixed power source 101, the voltage $V_{ss}$ of the second fixed power source 102 and the voltage $V_m$ ($=V_{cc}$) of the third fixed power source 103. Thus, as described above, the value of each power source voltage is set so that the voltage between the first fixed power source 101 and the third fixed power source 103, and the voltage between the third fixed power source 103 and the second fixed power source 102 are set to be voltages within the range of the source-drain withstand voltage ($V_{cc}-V_{ss}$, in the example) of each transistor.

The circuit operation described above is performed under the above condition so that the output voltage $V_A$ of the amplitude of $2V_{cc}-V_{ss}$ may be obtained while the source-drain voltage of each transistor configuring the present level shifter circuit $\mathbf{100}_A$ is suppressed within the range of the source-drain withstand voltage ($V_{cc}-V_{ss}$) of the transistors.

2-3. Actions and Effects of First Embodiment

The level shifter circuit $\mathbf{100}_A$ according to the first embodiment performs an action of level shifting (level conversion) in a direction where the input voltages $V_{IN}$ and $V_{XIN}$ are increased. Thus, the level shifter circuit $\mathbf{100}_A$ is arranged as the circuit of the preceding stage of the inverter circuit 200 of the final stage. By doing so, at the time of reducing the resistance of the inverter circuit 200 of the final stage, the gate-source voltage of the transistors $P_{21}$ and $N_{21}$ may be increased, that is, the amplitude of the input voltage of the inverter circuit 200 may be increased without increasing the size of the transistors $P_{21}$ and $N_{21}$ configuring the inverter circuit 200.

In addition, when the first to fourth transistor circuits 111 to 114 are configured of the double gate transistor and two transistor circuits of the power source side of one side is in the operating state, the voltage $V_m$ of the third fixed power source 103 is applied to the common connection node of the double gate transistor of two transistor circuits of the power source side of the other side.

Specifically, when the second transistor circuit 112 is in the operating state, the voltage $V_m$ of the third fixed power source 103 is applied to the common connection node $n_{11}$ of the double gate transistors ($P_{11}$ and $P_{12}$) of the first transistor circuit 111 via the P channel transistor $P_{15}$. Further, when the fourth transistor circuit 114 is in the operating state, the voltage $V_m$ of the third fixed power source 103 is applied to the common connection node $n_{13}$ of the double gate transistors ($P_{13}$ and $P_{14}$) of the third transistor circuit 113 via the P channel transistor $P_{16}$.

Accordingly, the source-drain voltage of each transistor configuring the present level shifter circuit $\mathbf{100}_A$ may be suppressed within the range of the source-drain withstand voltage ($V_{cc}-V_{ss}$) of the transistors. Thus, the amplitude of the input voltage of the inverter circuit 200 of the final stage may be increased while the source-drain withstand voltage of each transistor configuring the level shifter circuit $\mathbf{100}_A$ is maintained.

In this case, the amplitude of the waveform which is input to the inverter circuit 200 of the final stage is ($2V_{cc}-V_{ss}$) and the voltage exceeding the source-drain withstand voltage ($V_{cc}-V_{ss}$) is applied between the gate and the source of the transistors $P_{21}$ and $N_{21}$ configuring the inverter circuit 200 of the final stage. However, generally, the gate-source withstand voltage of the transistor is larger (higher) than the source-drain withstand voltage. Accordingly, the voltage exceeding the source-drain withstand voltage may be applied between the gate and the source of the transistors $P_{21}$ and $N_{21}$. Thus, the gate-source voltage of the transistors $P_{21}$ and $N_{21}$ is increased, that is, the amplitude of the input voltage of the inverter circuit 200 of the final stage is increased and thereby the resistance of the inverter circuit 200 may be reduced.

As described above, according to the level shifter circuit $\mathbf{100}_A$ of the first embodiment, the amplitude of the input voltage of the inverter circuit 200 of the final stage may be increased while the source-drain withstand voltage of each transistor configuring the level shifter circuit $\mathbf{100}_A$ is maintained. Further, the amplitude of the input voltage of the inverter circuit 200 of the final stage is further increased and thereby the size of the transistors $P_{21}$ and $N_{21}$ configuring the inverter 200 may be reduced. Furthermore, since a flow-through current does not flow in the normal state, power consumption may be low.

3. Second Embodiment 3-1. Circuit Configuration

Figure 5:
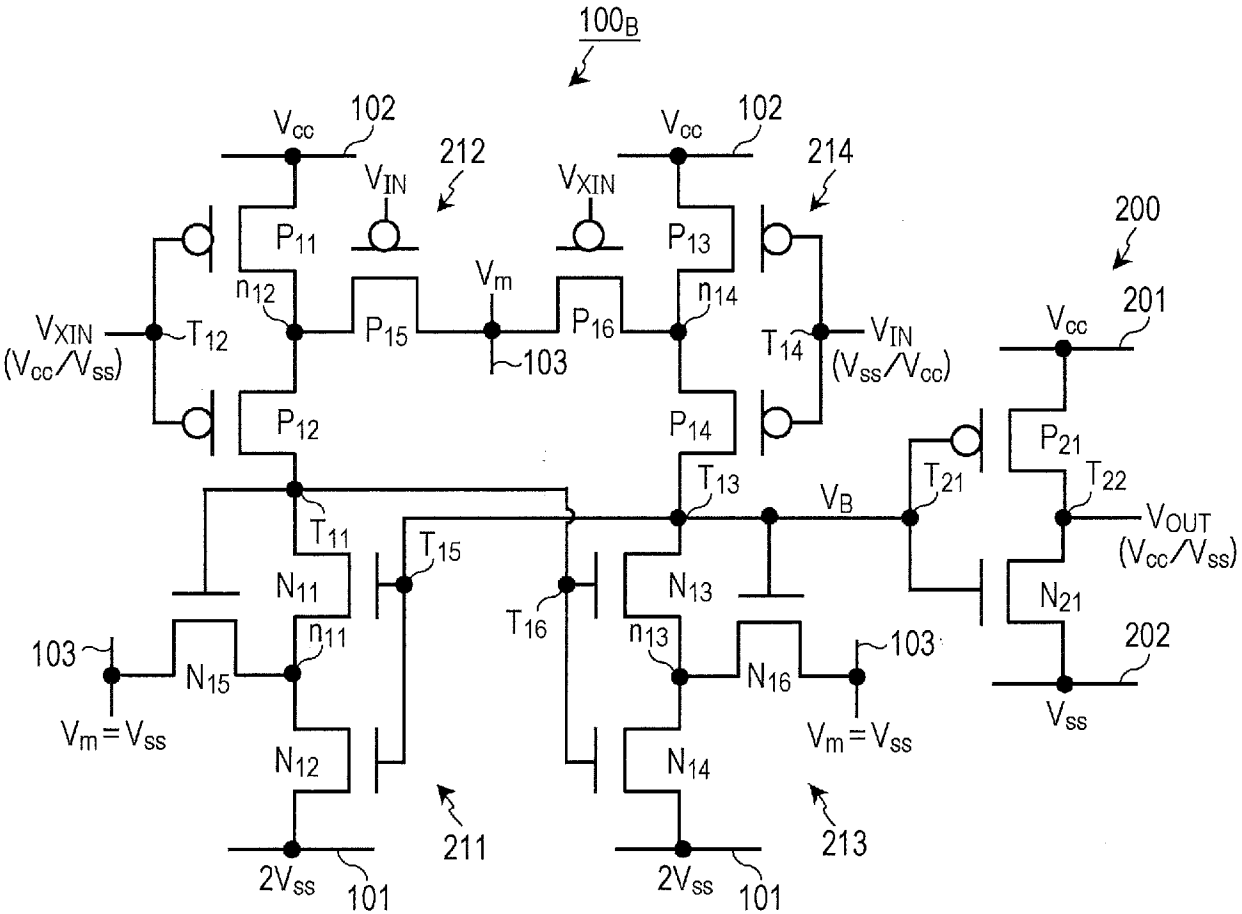
FIG. 5 is a circuit diagram illustrating an example of a configuration of a level shifter circuit according to a second embodiment of the present disclosure.

FIG. 5 is a circuit diagram illustrating an example of a configuration of the level shifter circuit according to a second embodiment of the present disclosure. A level shifter circuit $\mathbf{100}_B$ of the second embodiment employs the second circuit form described above. In other words, the first fixed power source 101 is the negative side power source, the second fixed power source 102 is the positive side power source, the N channel transistor is used as a first conductive type transistor, and P channel transistor is used as a second conductive type transistor.

In FIG. 5, The level shifter circuit $\mathbf{100}_B$ according to the second embodiment is configured of four transistor circuits of a first transistor circuit 211, a second transistor circuit 212, a third transistor circuit 213 and a fourth transistor circuit 214. The first transistor circuit 211 and the second transistor circuit 212 are connected serially between the first fixed power source 101 that is the negative side power source and the second fixed power source 102 that is the positive side power source. Similarly, the third transistor circuit 213 and the fourth transistor circuit 214 are connected serially between the first fixed power source 101 and the second fixed power source 102.

Two transistor circuits of the first fixed power source 101 side, that is, the first transistor circuit 211 and the third transistor circuit 213 are configured of the N channel transistor. Two transistor circuits of the second fixed power source 102 side, that is, the second transistor circuit 212 and the fourth transistor circuit 214 are configured of the N channel transistor. Thus, two transistor circuits 211 and 213 of the first fixed power source 101 side and two transistor circuits 212 and 214 of the second fixed power source 102 side are together formed of the double gate transistor.

However, this is merely an example, and only two transistor circuits of one side in two transistor circuits 211 and 213 of the first fixed power source 101 side and two transistor circuits 212 and 214 of the second fixed power source 102 side may employ the configuration configured of the double gate transistor. When only two transistor circuits of one side are configured of the double gate transistor, two transistor circuits of the other side are configured of a single gate transistor.

The first transistor circuit 211 is configured of two N channel transistors $N_{11}$ and $N_{12}$ having the double gate structure where respective gate electrodes are connected in common. A source electrode of the N channel transistor $N_{11}$ is the output terminal $T_{11}$ of the first transistor circuit 211. The drain electrode of the N channel transistor $N_{11}$ and the drain electrode of the N channel transistor $N_{12}$ are connected in common and thereby become a common connection node $n_{11}$ of the double gate transistors ($N_{11}$ and $N_{12}$). The source electrode of the N channel transistor $N_{12}$ is connected to the first fixed power source 101.

The second transistor circuit 212 is configured of two P channel transistors $P_{11}$ and $P_{12}$ having the double gate structure where the gate electrodes are connected in common together. The gate electrode connected in common to two P channel transistors $P_{11}$ and $P_{12}$ is the input terminal $T_{12}$ of the second transistor circuit 212. The source electrode of the P channel transistor $P_{11}$ is connected to the second fixed power source 102. The drain electrode of the P channel transistor $P_{11}$ and the source electrode of the P channel transistor $P_{12}$ are connected in common and thereby become the common connection node $n_{12}$ of the double gate transistors ($P_{11}$ and $P_{12}$).

The drain electrode of the P channel transistor $P_{12}$ is the output terminal $T_{11}$ of the second transistor circuit 212. The output terminal $T_{11}$ of the second transistor circuit 212 is also the output terminal $T_{11}$ of the first transistor circuit 211. In other words, the drain electrode of the P channel transistor $P_{12}$ and the drain electrode of the N channel transistor $N_{11}$ are connected in common and thereby become the output terminal $T_{11}$ of the first and the second transistor circuits 211 and 212.

The third transistor circuit 213 is configured of two N channel transistors $N_{13}$ and $N_{14}$ having the double gate structure where the gate electrodes are connected in common together. The drain electrode of the N channel transistor $N_{13}$ is the output terminal $T_{13}$ of the third transistor circuit 213. The source electrode of the N channel transistor $N_{13}$ and the drain electrode of the N channel transistor $N_{14}$ are connected in common and thereby become the common connection node $n_{13}$ of the double gate transistors ($N_{13}$ and $N_{14}$). The source electrode of the N channel transistor $N_{14}$ is connected to the first fixed power source 101.

The fourth transistor circuit 214 is configured of two P channel transistors $P_{13}$ and $P_{14}$ having the double gate structure where the gate electrodes are connected in common together. The gate electrode connected in common to two P channel transistors $P_{13}$ and $P_{14}$ is the input terminal $T_{14}$ of the fourth transistor circuit 214. The source electrode of the P channel transistor $P_{13}$ is connected to the second fixed power source 102. The drain electrode of the P channel transistor $P_{13}$ and the source electrode of the P channel transistor $P_{14}$ are connected in common and thereby become the common connection node $n_{14}$ of the double gate transistors ($P_{13}$ and $P_{14}$).

The drain electrode of the P channel transistor $P_{14}$ is the output terminal $T_{13}$ of the fourth transistor circuit 214. The output terminal $T_{13}$ of the fourth transistor circuit 214 is also the output terminal $T_{13}$ of the third transistor circuit 213. In other words, the drain electrode of the P channel transistor $P_{14}$ and the drain electrode of the N channel transistor $N_{13}$ are connected in common and thereby become the output terminal $T_{13}$ of the third and the fourth transistor circuits 213 and 214. In addition, the output terminal $T_{13}$ of the third and the fourth transistor circuits 213 and 214 is also the output terminal of the present level shifter circuit $\mathbf{100}_B$.

In the level shifter circuit $\mathbf{100}_B$ described above, the first and the second input voltages $V_{XIN}$ and $V_{IN}$ are applied to two transistor circuits of the second fixed power source 102 side, that is, to each of the input ends $T_{12}$ and $T_{14}$ of the second and the fourth transistors 212 and 214. The first and the second input voltages $V_{XIN}$ and $V_{IN}$ are reverse phased voltages to each other in which the high level is $V_{cc}$ and the low level is $V_{ss}$.

With respect to the first and the second input voltages $V_{XIN}$ and $V_{IN}$, the voltage of the first fixed power source 101 is set to be for example, $2V_{ss}$, that is the voltage lower than the voltage V, of the low voltage side and the voltage of the second fixed power source 102 is set to be a voltage higher than or equal to the voltage $V_{cc}$ of the high voltage side, for example, to be the same voltage. In addition, the source-drain withstand voltage of each transistor circuits 211 to 214 configuring the level shifter circuit $\mathbf{100}_B$, that is, the first to fourth transistor circuits 211 to 214 is considered to be $(V_{cc}-V_{ss})$.

The input terminal $T_{15}$ of the first transistor circuit 211, that is, the gate electrode of the double gate transistors ($N_{11}$ and $N_{12}$) is connected to the output terminal $T_{13}$ of the third and the fourth transistor circuits 213 and 214. In addition, the input terminal $T_{16}$ of the third transistor circuit 213, that is, the gate electrode of the double gate transistors ($N_{13}$ and $N_{14}$) is connected to the output terminal $T_{11}$ of the first and second transistor circuits 211 and 212.

As described above, the level shifter circuit $\mathbf{100}_B$ according to the present embodiment has the following characteristics in addition to the characteristics in which four transistor circuits of the first transistor circuit 211, the second transistor circuit 212, the third transistor circuit 213 and the fourth transistor circuit 214 are configured of the double gate transistor.

The switch element, for example, the N channel transistor $N_{15}$ that is the same conductive type as the transistor configuring the first transistor circuit 211 is connected between the common connection node $n_{11}$ of the double gate transistors ($N_{11}$ and $N_{12}$) configuring the first transistor circuit 211 and the third fixed power source 103. The N channel transistor $N_{15}$ is configured such that the source/drain electrode of one side is connected to the common connection node $n_{11}$ of the double gate transistors ($N_{11}$ and $N_{12}$) and the source/drain electrode of the other side is connected to the third fixed power source 103.

The N channel transistor $N_{15}$ is configured such that the gate electrode is connected to the output terminal $T_{11}$. Thus, the N channel transistor $N_{15}$ is in the conductive state and thereby the voltage $V_m$ of the third fixed power source 103 is applied to the common connection node $n_{11}$ of the double gate transistors ($N_{11}$ and $N_{12}$) of the first transistor circuit 211 when the second transistor circuit 212 is in the operating state. Here "when the second transistor circuit 212 is in the operating state" is when the P channel transistors $P_{11}$ and $P_{12}$ configuring the second transistor circuit 212 are in the conductive state.

The switch element, for example, the P channel transistor $P_{15}$ that is the same conductive type as the transistor configuring the second transistor circuit 212 is connected between the common connection node $n_{12}$ of the double gate transistors ($P_{11}$ and $P_{12}$) configuring the second transistor circuit 212 and the third fixed power source 103. The P channel transistor $P_{15}$ is configured such that the source/drain electrode of one side is connected to the common connection node $n_{12}$ of the double gate transistors ($P_{11}$ and $P_{12}$) and the source/drain electrode of the other side is connected to the third fixed power source 103.

The P channel transistor $P_{15}$ is configured such that the second input voltage $V_{IN}$ is applied to the gate electrode. Thus, the P channel transistor $P_{15}$ is in the conductive state and thereby the voltage $V_m$ of the third fixed power source 103 is applied to the common connection node $n_{12}$ of the double gate transistors ($P_{11}$ and $P_{12}$) of the second transistor circuit 212 when the first transistor circuit 211 is in the operating state. Here, "when the first transistor circuit 211 is in the operating state" is when the N channel transistors $N_{11}$ and $N_{12}$ configuring the first transistor circuit 211 are in the conductive state.

The switch element, for example, the N channel transistor $N_{16}$ that is the same conductive type as the transistor configuring the third transistor circuit 213 is connected between the common connection node $n_{13}$ of the double gate transistors ($N_{13}$ and $N_{14}$) configuring the third transistor circuit 213 and the third fixed power source 103. The N channel transistor $N_{16}$ is configured such that the source/drain electrode of one side is connected to the common connection node $n_{13}$ of the double gate transistors ($N_{13}$ and $N_{14}$) and the source/drain electrode of the other side is connected to the third fixed power source 103.

The N channel transistor $N_{16}$ is configured such that the gate electrode is connected to the output terminal $T_{13}$. Thus, the N channel transistor $N_{16}$ is in the conductive state and thereby the voltage $V_m$ of the third fixed power source 103 is applied to the common connection node $n_{13}$ of the double gate transistors ($N_{13}$ and $N_{14}$) of the third transistor circuit 213 when the fourth transistor circuit 214 is in the operating state. Here, "when the fourth transistor circuit 214 is in the operating state" is when the P channel transistors $P_{13}$ and $P_{14}$ configuring the fourth transistor circuit 214 are in the conductive state.

The switch element, for example, the P channel transistor $P_{16}$ that is the same conductive type as the transistor configuring the fourth transistor circuit 214 is connected between the common connection node $n_{14}$ of the double gate transistors ($P_{13}$ and $P_{14}$) configuring the fourth transistor circuit 214 and the third fixed power source 103. The P channel transistor $P_{16}$ is configured such that the source/drain electrode of one side is connected to the common connection node $n_{14}$ of the double gate transistors ($P_{13}$ and $P_{14}$) and the source/drain electrode of the other side is connected to the third fixed power source 103.

The P channel transistor $P_{16}$ is configured such that the first input voltage $V_{XIN}$ is applied to the gate electrode. Thus, the P channel transistor $P_{16}$ is in the conductive state and thereby the voltage $V_m$ of the third fixed power source 103 is applied to the common connection node $n_{14}$ of the double gate transistors ($P_{13}$ and $P_{14}$) of the fourth transistor circuit 214 when the third transistor circuit 213 is in the operating state. Here, "when the third transistor circuit 213 is in the operating state" is when the N channel transistors $N_{13}$ and $N_{14}$ configuring the third transistor circuit 213 are in the conductive state.

Here, as the voltage $V_m$ of the third fixed power source 103, the value between voltages of the first and the second fixed power supplies 101 and 102, the average value of each of the voltages $V_{cc}$ and $2V_{ss}$ of the first and the second fixed power supplies 101 and 102 is favorably used. In the case of the present example, $V_m=V_{ss}$. Further, the voltage between the first fixed power source 101 and the third fixed power source 103, and the voltage between the third fixed power source 103 and the second fixed power source 102 are the voltages within the range of the source-drain withstand voltage $(V_{cc}-V_{ss})$ of each transistor configuring the first to fourth transistor circuits 211 to 214.

It is preferable that the level shifter circuit $\mathbf{100}_B$ of the configuration described above be used by assembling with the inverter circuit 200 of the final stage similarly to the first embodiment. The inverter circuit 200 of the final stage is configured such that the voltage of the positive side power source 201 is set to be the same as the voltage $V_{cc}$ of the high voltage side of the input voltages $V_{IN}$ and $V_{XIN}$ and the voltage of the negative side power source 202 is set to be the same as the voltage $V_{ss}$ of the low voltage side of the input voltages $V_{IN}$ and $V_{XIN}$ respectively. Accordingly, the voltage $2V_{ss}$ of the first fixed power source 101 of the level shifter circuit $\mathbf{100}_B$ of the preceding stage is lower than the voltage $V_{ss}$ of the negative side power source 102 of the inverter circuit 200 of the final stage and the voltage $V_{cc}$ of the second fixed power source 102 is the same as the voltage $V_{cc}$ of the positive side power source 201 of the inverter circuit 200 of the final stage.

3-2. Circuit Operation

Subsequently, the circuit operation of the level shifter circuit $\mathbf{100}_B$ according to the second embodiment of the above configuration is described using FIGS. 6 and 7. Each waveform of two input voltages $V_{IN}$ and $V_{XIN}$ which are reversely phased to each other, the output voltage $V_B$ of the level shifter circuit $\mathbf{100}_B$, and the output voltage $V_{OUT}$ of the inverter circuit 200 of the final stage is illustrated in FIG. 8.

Figure 6:
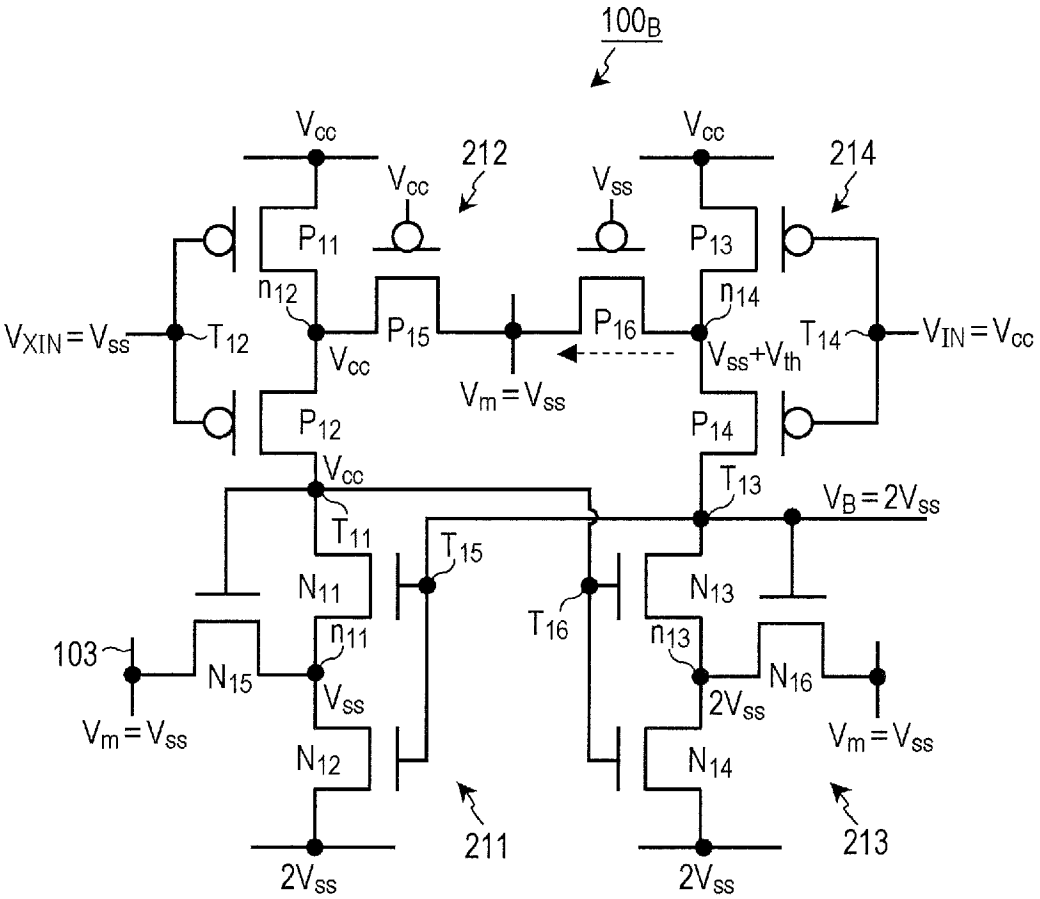
FIG. 6 is an operation illustrative view providing a description of the circuit operation of the level shifter circuit according to the second embodiment when the input voltage $V_{IN}$ of one side is the high level $V_{cc}$ and the input voltage $V_{XIN}$ of the other side is the low level $V_{ss}$.

First, the circuit operation is described using the illustrative operation view of FIG. 6 when the input voltage $V_{IN}$ of one side is the high level $V_{cc}$ and the input voltage $V_{XIN}$ of the other side is the low level $V_{ss}$.

When the input voltage $V_{IN}$ of one side is the high level $V_{cc}$ and the input voltage $V_{XIN}$ of the other side is the low level $V_{ss}$, the P channel transistors $P_{11}$ and $P_{13}$ of the second transistor circuit 212 and the P channel transistor $P_{16}$ of the fourth transistor circuit 214 side are in a conductive state. Accordingly, each gate electric potential of the N channel transistors $N_{13}$ and $N_{14}$ of the third transistor circuit 213, and the N channel transistor $N_{15}$ of the first transistor circuit 211 side is the high level $V_{cc}$.

According to the operation, since the N channel transistors $N_{13}$ and $N_{14}$ of the third transistor circuit 213, and the N channel transistor $N_{15}$ of the first transistor circuit 211 side are in the conductive state, the output voltage $V_B$ of the present level shifter circuit $\mathbf{100}_B$ is the voltage $2V_{ss}$, of the first fixed power source 101. At this time, since $V_m=V_{ss}$, the electric potential of the common connection node $n_{11}$ of the double gate transistors ($N_{11}$ and $N_{12}$) of the first transistor circuit 211 is $V_{ss}$. Further, when the threshold voltage of the P channel transistor $P_{16}$ is $V_{th}$, the electric potential of the common connection node $n_{14}$ of the double gate transistors ($P_{13}$ and $P_{14}$) of the fourth transistor circuit 214 is a value of $V_{ss}+V_{th}$.

Figure 7:
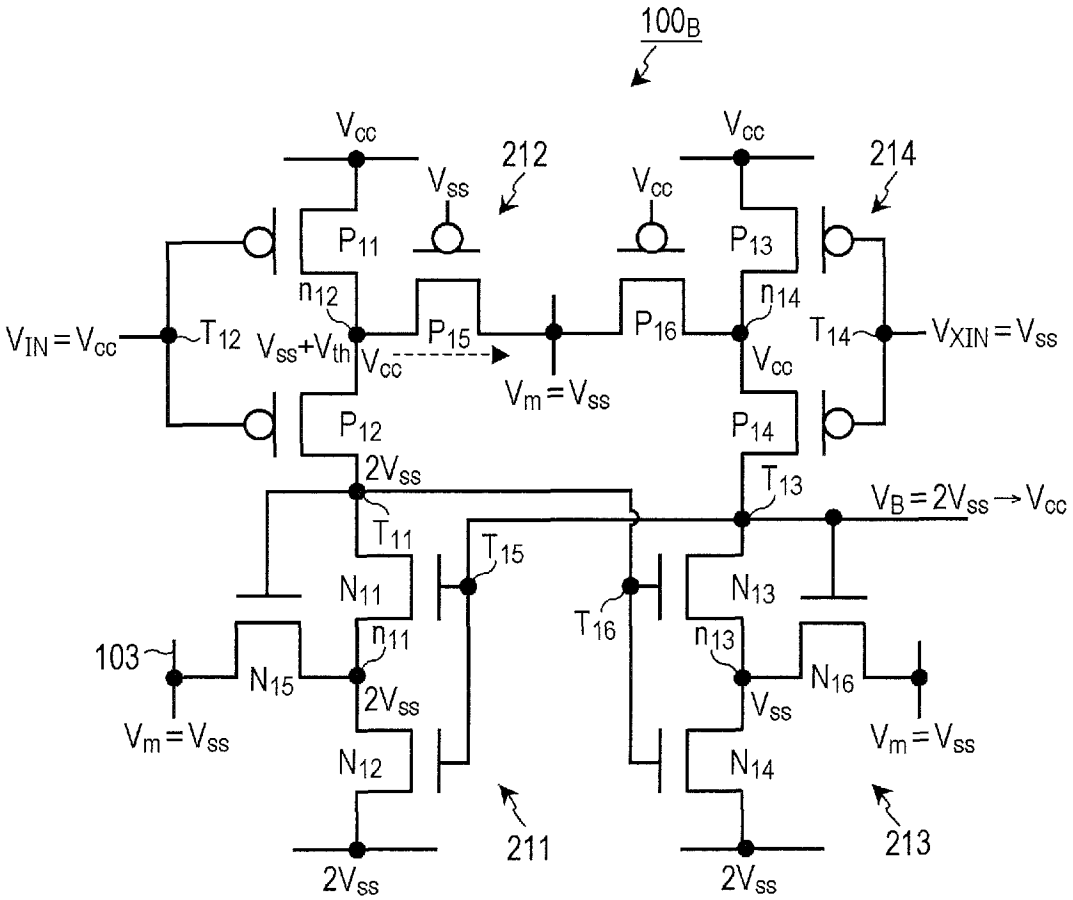
FIG. 7 is an operation illustrative view providing a description of the circuit operation of the level shifter circuit according to the second embodiment when the input voltage $V_{IN}$ of one side is the low level $V_{ss}$ and the input voltage $V_{XIN}$ of the other side is the high level $V_{cc}$.
Figure 8:
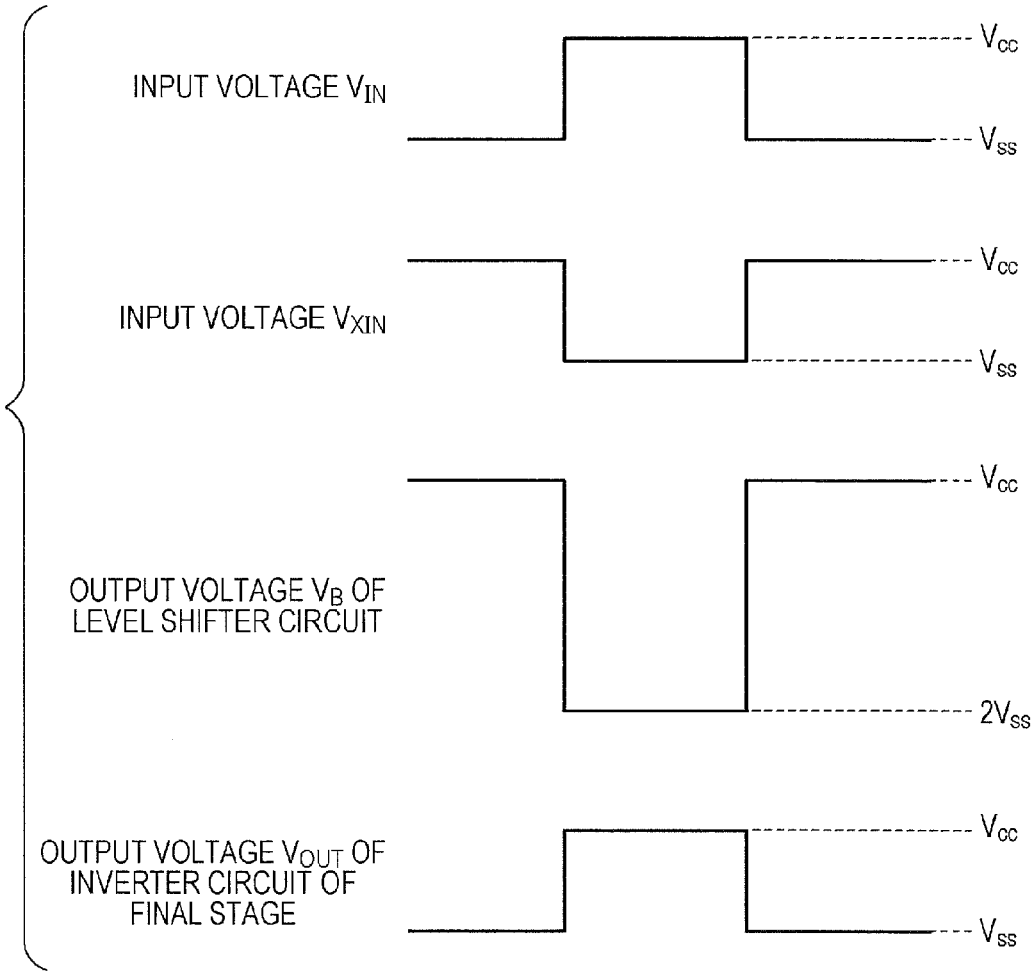
FIG. 8 is a waveform diagram illustrating each waveform of two input voltages $V_{IN}$ and $V_{XIN}$ in the level shifter circuit, the output voltage $V_A$ of the level shifter circuit, and the output voltage $V_{OUT}$ of the inverter circuit of the final stage of the level shifter circuit according to the second embodiment.

Next, the circuit operation is described using the illustrative operation view of FIG. 7 when the input voltage $V_{IN}$ of one side is the low level V, and the input voltage $V_{XIN}$ of the other side is the high level $V_{cc}$.

When the input voltage $V_{IN}$ of one side is the low level $V_{ss}$ and the input voltage $V_{XIN}$ of the other side is the high level $V_{cc}$, the P channel transistors $P_{13}$ and $P_{14}$ of the fourth transistor circuit 214 and the P channel transistor $P_{15}$ of the second transistor circuit 212 side are in the conductive state. Accordingly, each gate electric potential (this is also the output voltage of the present level shifter circuit $\mathbf{100}_B$) $V_B$ of the N channel transistors $N_{11}$ and $P_{12}$ of the first transistor circuit 211 and the N channel transistor $N_{16}$ of the third transistor circuit 213 is transitioned from the voltage $2V_{ss}$ of the first fixed power source 101 to the voltage $V_{cc}$ of the second fixed power source 102.

The gate electric potential of the N channel transistors $N_{11}$ and $N_{12}$ of the first transistor circuit 211 is the high level $V_{cc}$, and the N channel transistors $N_{11}$ and $N_{12}$ are in the conductive state. Accordingly, since the gate electric potential of the N channel transistors $N_{13}$ and $N_{14}$ of the third transistor circuit 213 is the voltage $2V_{ss}$ of the first fixed power source 101, the N channel transistors $N_{13}$ and $N_{14}$ are in the nonconductive state. At this time, the electric potential of the common connection node $n_{13}$ of the double gate transistors ($N_{13}$ and $N_{14}$) of the third transistor circuit 213 is $V_{ss}$. Further, when the threshold voltage of the P channel transistor $P_{15}$ is $V_{th}$, the electric potential of the common connection node $n_{12}$ of the double gate transistors ($P_{11}$ and $P_{12}$) of the second transistor circuit 212 is $V_{ss}+V_{th}$.

Here, the source-drain voltage of each transistor configuring the present level shifter circuit $\mathbf{100}_B$ is considered. The source-drain voltage applied to each transistor is determined by each value of the voltage $2V_{ss}$ of the first fixed power source 101, the voltage $V_{cc}$ of the second fixed power source 102 and the voltage $V_m$ ($=V_{ss}$) of the third fixed power source 103. Thus, as described above, the value of each power source voltage is set so that the voltage between the first fixed power source 101 and the third fixed power source 103, and the voltage between the third fixed power source 103 and the second fixed power source 102 are set to be voltages within the range of the source-drain withstand voltage ($V_{cc}-V_{ss}$, in the example) of each transistor.

The circuit operations above are performed under the above described conditions so that the output voltage $V_A$ of the amplitude of $2V_{ss}-V_{cc}$ may be obtained while the source-drain voltage of each transistor configuring the present level shifter circuit $\mathbf{100}_B$ is suppressed within the range of the source-drain withstand voltage ($V_{cc}-V_{ss}$) of the transistors.

3-3. Actions and Effects of Second Embodiment

The level shifter circuit $\mathbf{100}_B$ according to the second embodiment may generally obtain the action and the effect similar to the level shifter circuit $\mathbf{100}_A$ according to the first embodiment. In other words, the amplitude of the input voltage of the inverter circuit 200 of the final stage may be increased, while the source-drain withstand voltage of each transistor is maintained, without increasing the size of the transistors $P_{21}$ and $N_{21}$ configuring the inverter circuit 200 of the final stage.

In the circuit operation, the configuration thereof is different from the level shifter circuit $\mathbf{100}_A$ according to the first embodiment, however, the obtained action and the effect thereof are the same as the level shifter circuit $\mathbf{100}_A$ Specifically, when the second transistor circuit 212 is in the operating state, the voltage $V_m$ of the third fixed power source 103 is applied to the common connection node $n_{11}$ of the double gate transistors ($N_{11}$ and $N_{12}$) of the first transistor circuit 211 via the N channel transistor $N_{15}$. Further, when the fourth transistor circuit 214 is in the operating state, the voltage $V_m$ of the third fixed power source 103 is applied to the common connection node $n_{13}$ of the double gate transistors ($N_{13}$ and $N_{14}$) of the third transistor circuit 213 via the P channel transistor $N_{16}$.

Accordingly, the source-drain voltage of each transistor configuring the present level shifter circuit $\mathbf{100}_B$ may be suppressed within the range of the source-drain withstand voltage ($V_{cc}-V_{ss}$) of the transistors. Thus, the amplitude of the input voltage of the inverter circuit 200 of the final stage may be increased while the source-drain withstand voltage of each transistor configuring the level shifter circuit $\mathbf{100}_B$ is maintained.

As described above, according to the level shifter circuit $\mathbf{100}_B$ of the second embodiment, the act and the effect may be obtained similar to the level shifter circuit $\mathbf{100}_A$ according to the first embodiment. In other words, the amplitude of the input voltage of the inverter circuit 200 of the final stage may be increased while the source-drain withstand voltage of each transistor configuring the level shifter circuit $\mathbf{100}_B$ is maintained. Further, the amplitude of the input voltage of the inverter circuit 200 of the final stage is further increased and thereby the size of the transistors $P_{21}$ and $N_{21}$ configuring the inverter 200 may be reduced. Furthermore, since a flow-through current does not flow in the normal state, power consumption may be low.

4. Third Embodiment

Figure 9:
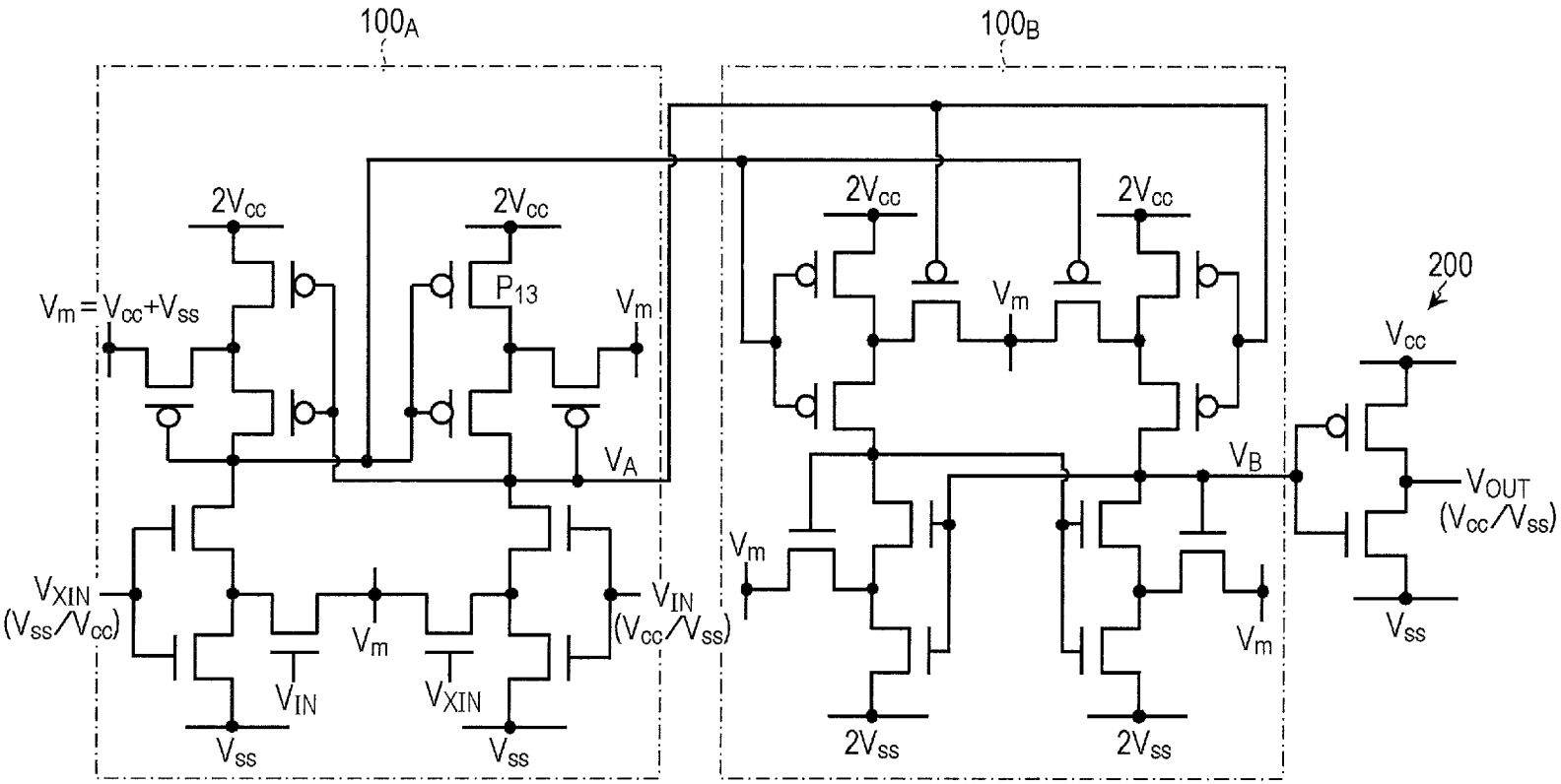
FIG. 9 is a circuit diagram illustrating an example of a configuration of a level shifter circuit according to a third embodiment of the present disclosure.

FIG. 9 is a circuit diagram illustrating an example of a configuration of the level shifter circuit according to a third embodiment of the present disclosure.

As shown in FIG. 9, a level shifter circuit $\mathbf{100}_C$ according to the third embodiment is configured of assembling with the level shifter circuit $\mathbf{100}_A$ according to the first embodiment and the level shifter circuit $\mathbf{100}_B$ according to the second embodiment. The sequence of the arrangement of the level shifter circuit $\mathbf{100}_A$ and the level shifter circuit $\mathbf{100}_B$ is arbitrary, and in the present example, a configuration is employed in which the level shifter circuit $\mathbf{100}_A$ is arranged at the preceding stage side (the first stage) and the level shifter circuit $\mathbf{100}_B$ is arranged at the latter stage (the second stage). Further, it is preferable that the level shifter circuit $\mathbf{100}_C$ according to the third embodiment be also used by assembling with the inverter circuit 200 of the final stage similar to the cases of the first and the second embodiments.

The voltage of the positive side power source is set to be $2V_{cc}$ and the voltage of the negative side power source is set to be $V_{ss}$ in the level shifter circuit $\mathbf{100}_A$ of the first stage. Accordingly, the voltage of the amplitude of $2V_{cc}-V_{ss}$ is derived as the output voltage $V_A$ of the level shifter circuit $\mathbf{100}_A$ of the first stage. Further, the voltage of the positive side power source is set to be $2V_{cc}$ and the voltage of the negative side power source is set to be $2V_{ss}$ in the level shifter circuit $\mathbf{100}_B$ of the second stage. Accordingly, the voltage of the amplitude of $2V_{cc}-2V_{ss}$ is derived as the output voltage $V_B$ of the level shifter circuit $\mathbf{100}_B$ of the first stage.

Figure 10:
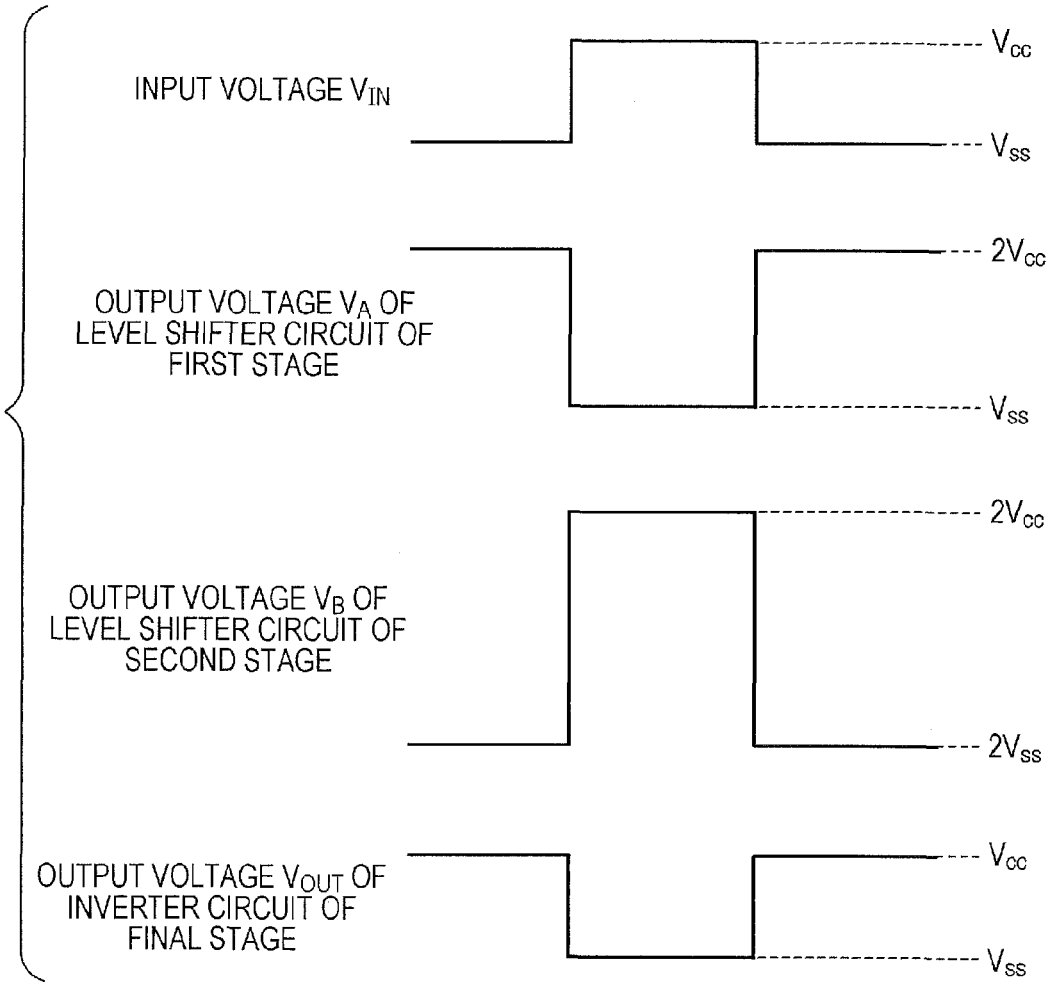
FIG. 10 is a waveform diagram illustrating each waveform of the input voltage $V_{IN}$ of the level shifter circuit, the output voltage $V_A$ of the level shifter circuit in a first stage, the output voltage $V_B$ of the level shifter circuit in a second stage and the output voltage $V_{OUT}$ of the inverter circuit in the final stage of the level shifter circuit according to the third embodiment.

Each waveform of the input voltage $V_{IN}$, the output voltage $V_A$ of the level shifter circuit $\mathbf{100}_A$ of the first stage, the output voltage $V_B$ of the level shifter circuit $\mathbf{100}_B$ of the second stage, and the output voltage $V_{OUT}$ of the inverter circuit 200 of the final stage is illustrated in FIG. 10.

As described above, the level shifter circuit $\mathbf{100}_C$ is configured of a cascade connection in a plurality (two stages in the present example) of stages and then the amplitude of the input voltage of the inverter circuit 200 of the final stage may be further increased while the source-drain withstand voltage of each transistor configuring the level shifter circuit $\mathbf{100}_C$ is maintained. Accordingly, the size of the transistors $P_{21}$ and $N_{21}$ configuring the inverter circuit 200 of the final stage may be further reduced. In addition, in the normal state, the flow-through current may be reliably suppressed and the power consumption may be low.

The level shifter circuits $\mathbf{100}_A$, $\mathbf{100}_B$ and $\mathbf{100}_C$ according to each of embodiments described above may be used, for example, as the circuit of the preceding stage of the inverter circuit of the final stage in the scanning circuit having the inverter circuit in the final stage and may be also be used as various uses as the general level shifter circuit. Further, the level shifter circuits $\mathbf{100}_A$, $\mathbf{100}_B$ and $\mathbf{100}_C$ may be used as the circuit of the preceding stage of the inverter circuit of the final stage and the scanning circuit (the scanning circuit of the present disclosure) may be used as the scanning circuit which scans each of the pixels in the display device where the pixels including electro-optic elements are arranged in a matrix or in the solid-state imaging device where the pixels including photoelectric conversion elements are arranged in a matrix.

Below, the display device is described as the display device of the present disclosure which equips the scanning circuit having the level shifter circuits $\mathbf{100}_A$, $\mathbf{100}_B$ and $\mathbf{100}_C$ according to the first, the second and the third embodiments as the circuit of the preceding stage of the inverter circuit of the final stage.

5. Display Device 5-1. System Configuration

Figure 11:
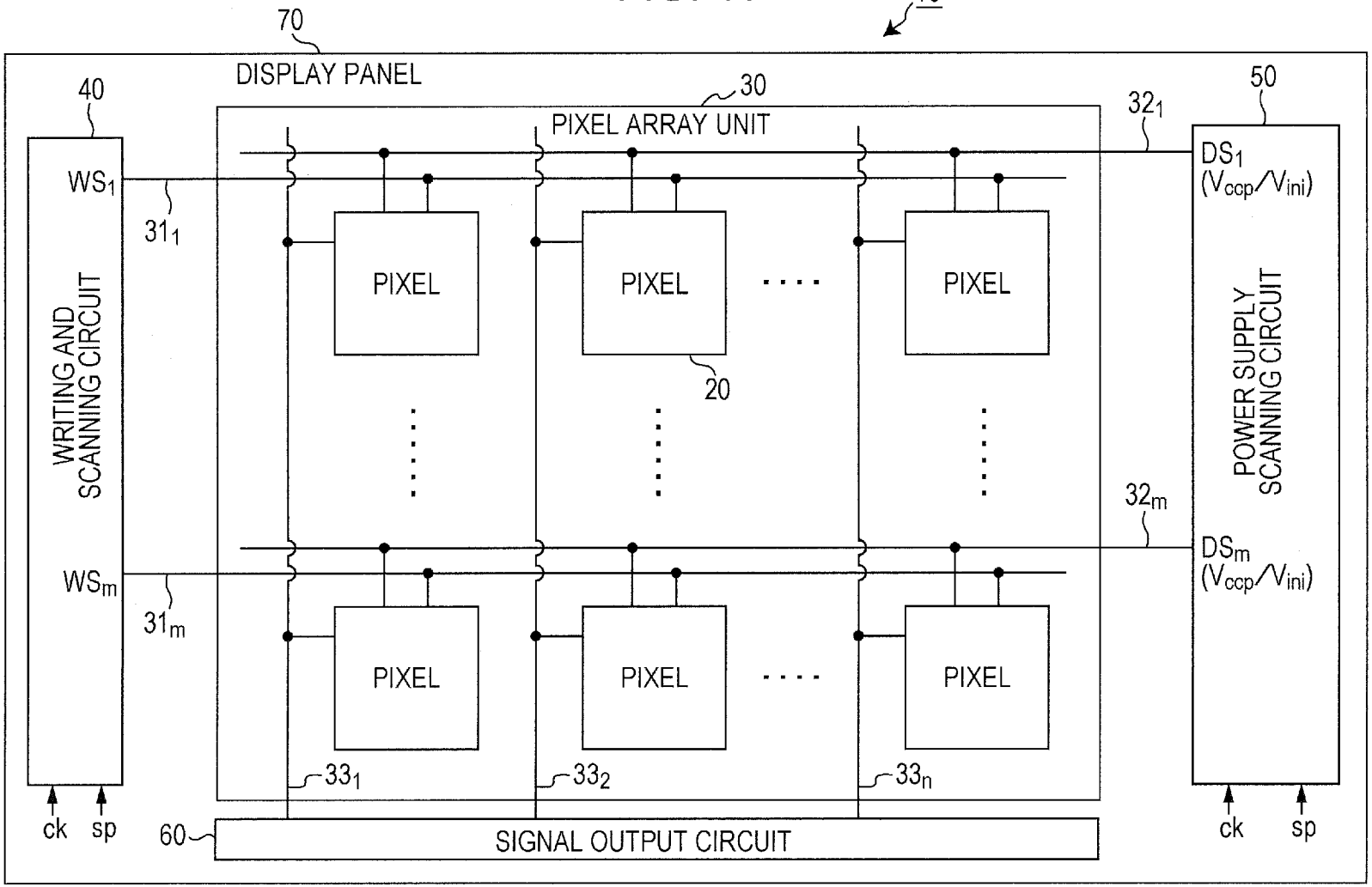
FIG. 11 is a system configuration diagram schematically illustrating a configuration of an organic EL display device of the present disclosure.

FIG. 11 is a system configuring view schematically illustrating the configuration of the display device of the present disclosure, for example, an active matrix type display device.

The active matrix type display device is a display device which controls the current flowing in the electro-optic element with an active element, for example, an insulation gate type field effect transistor provided in the same pixel as the electro-optic element. As the insulation gate type field effect transistor, TFT (Thin Film Transistor) is typically used.

Here, as an example, the active matrix type organic EL display device is described in which a current driving type electro-optic element where light emitting brightness changes according to the current value flowing in the device for example, the organic EL element is used as the light emitting element of pixels (pixel circuit).

As shown in FIG. 11, the organic EL display device 10 according to the present example has a pixel array unit 30 where a plurality of pixels 20 including the organic EL element is arranged in two dimensions in a matrix, and the driving circuit section arranged around the pixel array unit 30. The driving circuit section is configured of a writing and scanning circuit 40, a power supply scanning circuit 50, a signal output circuit 60 or the like, and drives each pixel 20 of the pixel array unit 30.

Here, when the organic EL display device 10 supports the color display, one pixel (the unit pixel), which is the unit forming the color image, is configured of a plurality of sub-pixels and each of the sub-pixels is equivalent to the pixel 20 in FIG. 11. More specifically, one pixel is configured of, for example, three sub-pixels of a sub-pixel emitting red (R) light, a sub-pixel emitting green (G) light and a sub-pixel emitting blue (B) light.

However, one pixel is not limited to the assembly of the sub-pixels of three primary colors of RGB and one pixel may be configured of further adding the sub-pixel of one color or a plurality of colors to the sub-pixels of three primary colors. More specifically, for example, it is possible for one pixel to be configured by adding the sub-pixel emitting white (W) light in order to improve the brightness, or for one pixel to be configured by adding at least one sub-pixel emitting a complementary light in order to enlarge the range of color reproduction.

Scanning lines $\mathbf{31}_1$ to $\mathbf{31}_m$ and the power source lines $\mathbf{32}_1$ to $\mathbf{32}_m$ are wired every pixel row along the row direction (a direction along the pixel row/an arrangement direction of pixels of the pixel row) in the arrangement of the pixel 20 of m rows and n columns in the pixel array unit 30. Further, signal lines $\mathbf{33}_1$ to $\mathbf{33}_n$ are wired every pixel column along the column direction (a direction along the pixel row/an arrangement direction of the pixel the pixel column) in the arrangement of the pixel 20 of m rows and n columns.

The scanning lines $\mathbf{31}_1$ to $\mathbf{31}_m$ are connected to the output ends of the rows corresponding to the writing and scanning circuit 40 respectively. The power source supplying lines $\mathbf{32}_1$ to $\mathbf{32}_m$ are connected to the output ends of the rows corresponding to the power supply scanning circuit 50 respectively. The signal lines $\mathbf{33}_1$ to $\mathbf{33}_n$ are connected to the output ends of the rows corresponding to the signal output circuit 60 respectively.

The pixel array unit 30 is usually formed on a transparent insulating substrate such as a glass substrate. Accordingly, the organic EL display device 10 has a panel structure of the planar surface type (the flat type) display device. The driving circuit of the each pixel 20 of the pixel array unit 30 may be formed by using an amorphous silicon or a low-temperature polysilicon TFT.

The writing and scanning circuit 40 is configured of the shift resistor circuit or the like which successively shifts the start pulse sp synchronized with the clock pulse ck. The writing and scanning circuit 40 successively supplies the writing and scanning signals WS ($WS_1$ to $WS_m$) to the scanning lines 31 ($\mathbf{31}_1$ to $\mathbf{31}_m$) and thereby each pixel 20 of the pixel array unit 30 is scanned (line sequential scanning) with the row unit when writing of the signal voltage of the image signal is performed to each pixel 20 of the pixel array unit 30.

The power supply scanning circuit 50 is configured of the shift resistor circuit or the like which successively shifts the start pulse sp synchronized with the clock pulse ck. The power supply scanning circuit 50 supplies a power source electric potentials DS ($DS_1$ to $DS_m$), which may change a first power source electric potential $V_{ccp}$ and a second power source electric potential $V_{ini}$ lower than the first power source electric potential $V_{ccp}$, to the power source lines 32 ($\mathbf{32}_1$ to $\mathbf{32}_m$), synchronized with the line sequential scanning in the writing and scanning circuit 40. The control of light emitting/non-light emitting of the pixel 20 is performed according to change of $V_{ccp}/V_{ini}$ of the power source electric potentials DS.

The signal output circuit 60 selectively outputs the signal voltage (also simply referred to as "signal voltage" in below) $V_{sig}$ of the image signal and the reference voltage $V_{ofs}$ according to the brightness information supplied from a signal supply source (not shown). Here, the reference voltage $V_{ofs}$ is an electric potential (for example, an electric potential corresponding to a black level of the image signal) which is the reference of the signal voltage $V_{sig}$ of the image signal.

The signal voltage $V_{sig}$/the reference voltage $V_{ofs}$, which is output from the signal output circuit 60, is written in the unit of pixel row selected by scanning in the writing and scanning circuit 40 with respect to each pixel 20 of the pixel array unit 30 via the signal lines 33 ($\mathbf{33}_1$ to $\mathbf{33}_n$). In other words, the signal output circuit 60 employs a driving form of line sequential writing which writes the signal voltage $V_{sig}$ in the row (line) unit.

5-2. Pixel Circuit

Figure 12:
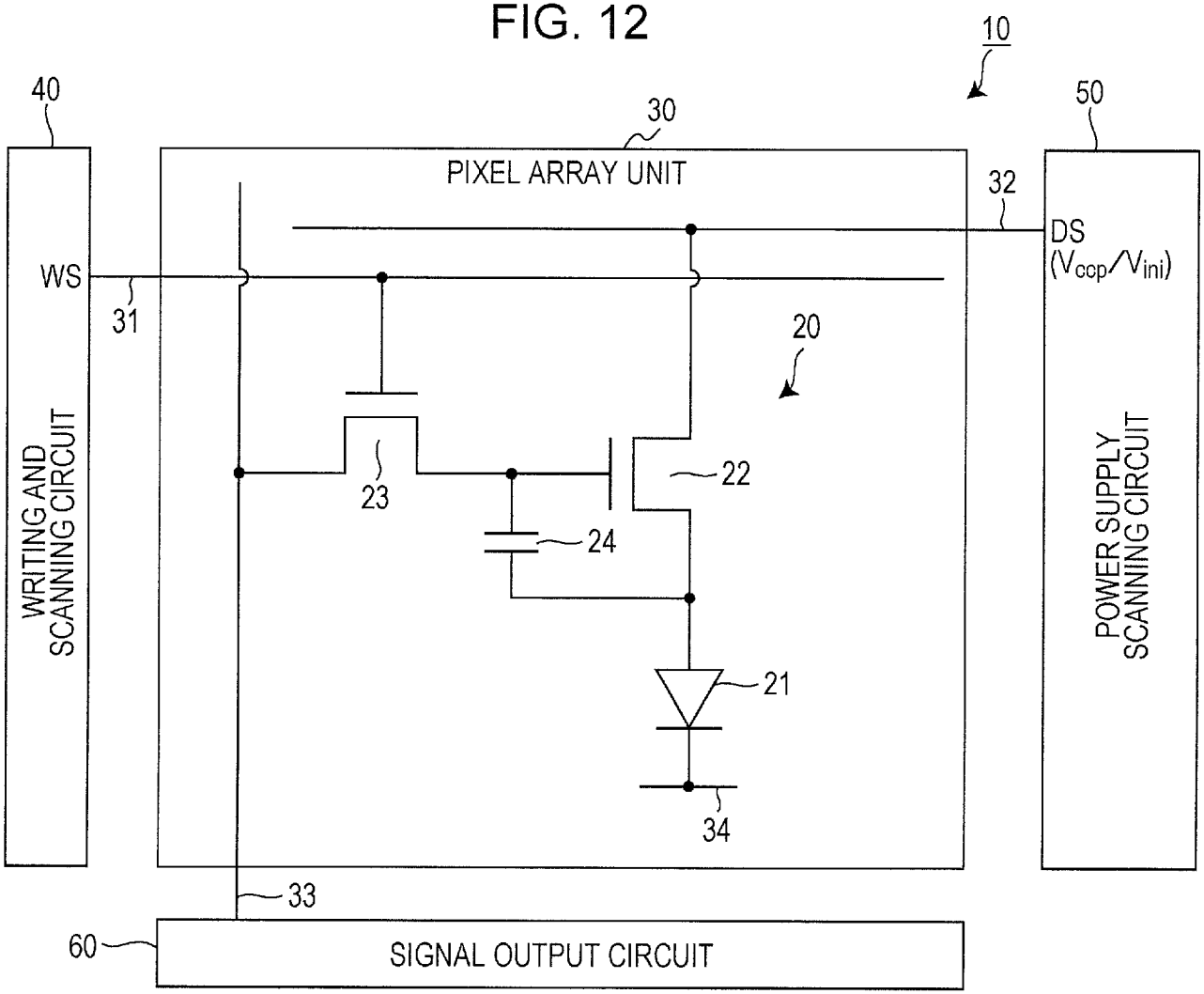
FIG. 12 is a circuit diagram illustrating an example of a specific circuit configuration of pixels (pixel circuit).

FIG. 12 is a circuit diagram illustrating an example of a specific circuit configuration of the pixel (the pixel circuit) 20. The light-emitting unit of the pixel 20 is formed of the organic EL element 21 that is the current driving type electro-optic element where the light emitting brightness changes according to the current value flowing in the device.

As shown in FIG. 12, the pixel 20 is configured of the organic EL element 21 and the driving circuit which drives the organic EL element 21 by flowing of the current in the organic EL element 21. The organic EL element 21 is configured such that a cathode electrode is connected to the common power source line 34 wired in common to all of the pixels 20.

The driving circuit driving the organic EL element 21 has a driving transistor 22, a writing transistor 23 and a retention capacitor 24. The N channel type TFT may be used as the driving transistor 22 and the writing transistor 23. However, the conductive type assembly of the driving transistor 22 and the writing transistor 23 is merely an example and the present disclosure is not limited to the assembly.

The driving transistor 22 is configured such that the electrode (the source/drain electrode) of one side is connected to the anode electrode of the organic EL element 21 and the electrode (the source/drain electrode) of the other side is connected to the power source lines 32 ($\mathbf{32}_1$ to $\mathbf{32}_m$).

The writing transistor 23 is configured such that the electrode (the source/drain electrode) of one side is connected to the signal lines 33 ($\mathbf{33}_1$ to $\mathbf{33}_n$) and the electrode (the source/drain electrode) of the other side is connected to the gate electrode of the driving transistor 22. Further, the gate electrode of the writing transistor 23 is connected to the scanning lines 31 ($\mathbf{31}_1$ to $\mathbf{31}_m$).

In the driving transistor 22 and the writing transistor 23, the electrode of one side is a metal wiring which is electrically connected to the source/drain region and the electrode of the other side is a metal wiring which is electrically connected to the drain/source region. Further, if the electrode of one side is the source electrode, it is also the drain electrode, and if the electrode of the other side is the drain electrode, it is also the source electrode, according to the electric potential relationship of the electrode of one side and the electrode of the other side.

The retention capacitor 24 is configured such that the electrode of one side is connected to the gate electrode of the driving transistor 22, and the electrode of the other side is connected to the electrode of the other side of the driving transistor 22 and to the anode electrode of the organic EL element 21.

In the pixel 20 of the configuration described above, the writing transistor 23 is in the conductive state in response to the writing and highly active scanning signal WS which is applied from the writing and scanning circuit 40 to the gate electrode via the scanning line 31. Accordingly, the writing transistor 23 samples the signal voltage $V_{sig}$ of the image signal or the reference voltage $V_{ofs}$ and writes them to the pixel 20 according to the brightness information supplied from the signal output circuit 60 via the signal line 33. The signal voltage $V_{sig}$ or the reference voltage $V_{ofs}$, which is written using the writing transistor 23, is applied to the gate electrode of the driving transistor 22 and is held in the retention capacitor 24.

When the power source electric potential DS of the power source supplying lines 32 ($\mathbf{32}_1$ to $\mathbf{32}_m$) is the first power source electric potential $V_{ccp}$, the driving transistor 22 operates in a saturated region in which the electrode of one side is the drain electrode and the electrode of the other side is the source electrode. Accordingly, the driving transistor 22 receives the supply of the current from the power source supplying line 32 and performs a current driving and then performs a light emitting driving of the organic EL element 21. More specifically, the driving transistor 22 is operated in the saturated region and supplies the driving current of the current value according to the voltage value of the signal voltage $V_{sig}$ held in the retention capacitor 24 to the organic EL element 21 and then emits the light by performing the current driving of the organic EL element 21.

When the power source electric potential DS changes from the first power source electric potential $V_{ccp}$ to the second power source electric potential $V_{ini}$, the driving transistor 22 operates as a switching transistor in which the electrode of one side is the source electrode and the electrode of the other side is the drain electrode. Accordingly, the driving transistor 22 stops the supply of the driving current to the organic EL element 21 and the organic EL element 21 is in the non-light emitting state. In other words, the driving transistor 22 also functions as a transistor controlling the light emitting/non-light emitting of organic EL element 21.

A period (a non-light emitting period) when the organic EL element 21 is in the non-light emitting state is provided according to the switching operation of the driving transistor 22 and a ratio (duty) of the light emitting period and the non-light emitting period of the organic EL element 21 may be controlled. Since a blurred afterimage may be reduced due to the light emitting of the pixels in one display frame period according to the duty control, specifically, the image quality of the moving image may be further excellent.

The first power source electric potential $V_{ccp}$ in the first and the second power source electric potentials $V_{ccp}$ and $V_{ini}$, which is selectively supplied from the power supply scanning circuit 50 via the power source line 32, is the power source electric potential to supply the driving current, which performs the light emitting driving of the organic EL element 21, to the driving transistor 22. Further, the second power source electric potential $V_{ini}$ is the power source electric potential to take the reverse bias to the organic EL element 21. The second power source electric potential $V_{ini}$ is set to be an electric potential lower than the reference voltage $V_{ofs}$, for example, to be an electric potential lower than $V_{ofs}-V_{th}$ when the threshold voltage of the driving transistor 22 is $V_{th}$, preferably an electric potential sufficiently lower than $V_{ofs}-V_{th}$.

5-3. Scanning Circuit

In the organic EL display device 10 described above, the level shifter circuits $\mathbf{100}_A$, $\mathbf{100}_B$ and $\mathbf{100}_C$ according to the first, the second and the third embodiments described above may be used as the circuit of the preceding stage of the inverter circuit of the final stage of the writing and scanning circuit 40 or the power supply scanning circuit 50 which is the peripheral circuit of the pixel array unit 30.

Here, as an example, the level shifter circuits $\mathbf{100}_A$, $\mathbf{100}_B$ and $\mathbf{100}_C$ according to the first, the second and the third embodiments are described in which the level shifter circuits are used as the circuit of the preceding stage of the inverter circuit of the final stage of the writing and scanning circuit 40.

Figure 13:
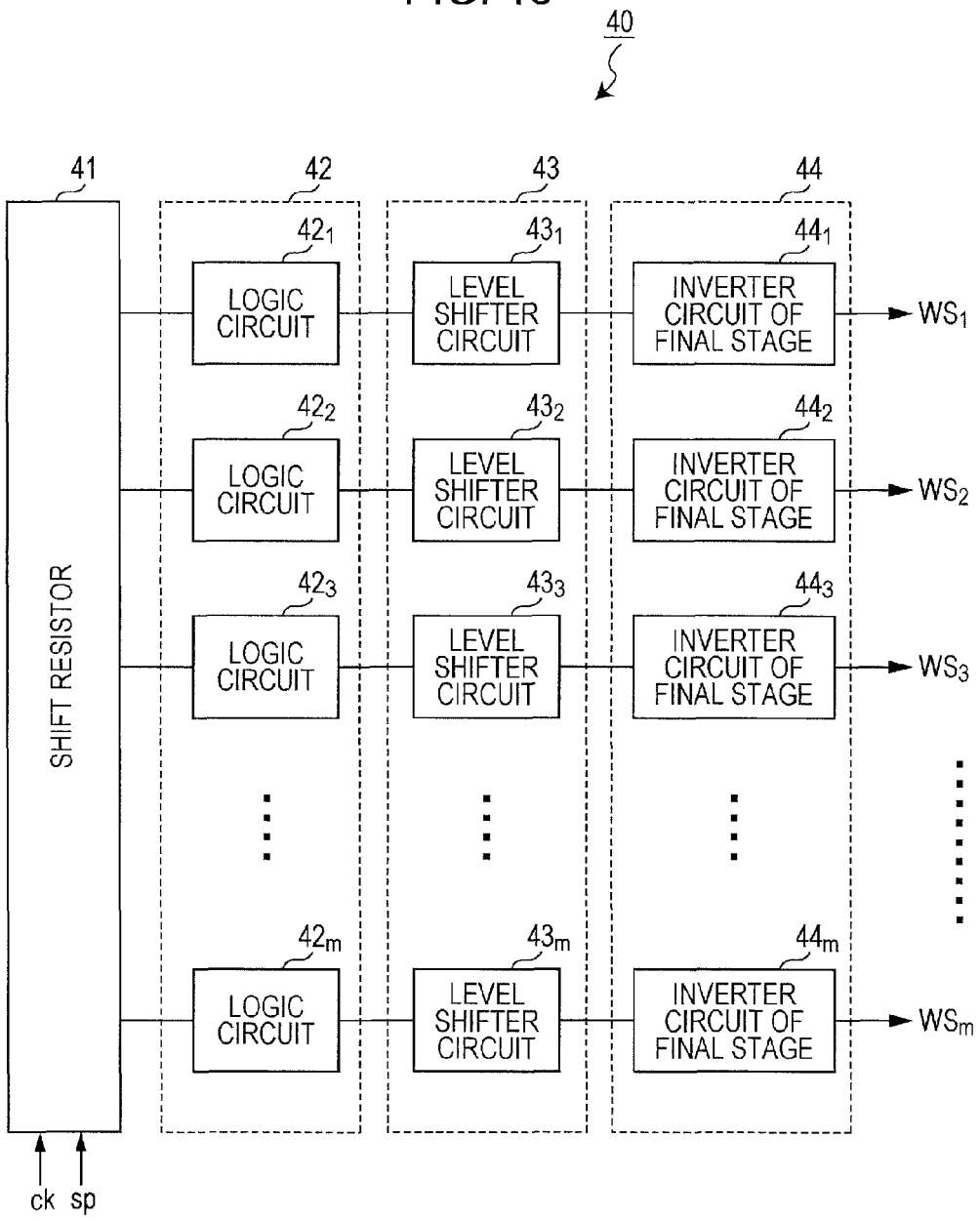
FIG. 13 is a block diagram illustrating an example of a configuration of a writing and scanning circuit.

FIG. 13 is a block diagram illustrating an example of a configuration of the writing and scanning circuit 40.

As shown in FIG. 13, the writing and scanning circuit 40 is configuration of, for example, a shift resistor circuit 41, a logic circuit group 42, a level shifter circuit group 43, and an inverter circuit group 44 of the final stage. The shift resistor circuit 41 is configured such that the shift stages (transfer stages/the unit circuit) of the number of stages corresponding to the number of rows m of the pixel array unit 30 are cascade connected and the start pulse sp is successively shifted synchronized with the clock pulse ck and then shift pulse is successively output from each shift stage.

The logic circuit group 42, the level shifter circuit group 43 and the inverter circuit group 44 are configured of logic circuits $\mathbf{42}_1$ to $\mathbf{42}_m$, level shifter circuits $\mathbf{43}_1$ to $\mathbf{43}_m$ and the inverter circuits $\mathbf{44}_1$ to $\mathbf{44}_m$ of the final stage of the number corresponding to the number of the rows m of the pixel array unit 30 respectively.

Each of logic circuits $\mathbf{42}_1$ to $\mathbf{42}_m$ of the logic circuit group 42 adjusts timing of the shift pulse output from the shift stage corresponding to the shift resistor circuit 41 to the scanning pulse of a predetermined timing. Each of level shifter circuits $\mathbf{43}_1$ to $\mathbf{43}_m$ of the level shifter circuit group 43 performs the level shift (the level conversion) of the scanning pulse of the logic level to the scanning pulse of higher level. Each of inverter circuits $\mathbf{44}_1$ to $\mathbf{44}_m$, of the inverter circuit group 44 of the final stage supplies the scanning pulse after the level shift to the scanning lines $\mathbf{31}_1$ to $\mathbf{31}_m$ of the pixel array unit 30 as the writing and scanning signals (the pulses) $WS_1$ to $WS_m$ with a reversed polarity.

In the writing and scanning circuit 40 of the configuration described above, the level shifter circuits $\mathbf{100}_A$, $\mathbf{100}_B$ and $\mathbf{100}_C$ according to each of embodiments described above may be used as each of the inverter circuits $\mathbf{44}_1$ to $\mathbf{44}_m$ of the inverter circuit group 44 of the final stage. As described above, the level shifter circuits $\mathbf{100}_A$, $\mathbf{100}_B$ and $\mathbf{100}_C$ may increase the amplitude of the voltage which inputs to the inverter circuit 200 of the final stage while maintaining the source-drain withstand voltage of each transistor configuring the level shifter circuit.

Thus, the gate-source voltage of the transistors $P_{21}$ and $N_{21}$ configuring the inverter circuit 200 of the final stage is increased and the resistance (that is, ON resistance of the transistors $P_{21}$ and $N_{21}$) of the inverter circuit 200 of the final stage is reduced so that the size of the display panel 70 may increase. More specifically, since the load of the scanning lines $\mathbf{31}_1$ to $\mathbf{31}_m$ becomes large due to the enlargement of the display panel 70, there is a concern that sharpness of the waveform of the scanning pulses $WS_1$ to $WS_m$ is reduced due to influence of the load. In addition, the resistance of the inverter circuit 200 of the final stage decreases and thereby the influence of the load may be suppressed to a minimum. Accordingly, the display panel 70 may be large.

Further, the amplitude of the input voltage of the inverter circuit 200 of the final stage is further increased and thereby the size of the transistors $P_{21}$ and $N_{21}$ configuring the inverter 200 may be reduced. Accordingly, circuit scale of the level shifter circuits $\mathbf{100}_A$, $\mathbf{100}_B$ and $\mathbf{100}_C$ and circuit scale of the writing and scanning circuit 40 or the power supply scanning circuit 50 which has the level shifter circuits $\mathbf{100}_A$, $\mathbf{100}_B$ and $\mathbf{100}_C$ as much as the number of rows of the pixel rows of the pixel array unit 30, may be reduced.

As a result, for example, as shown in FIG. 11, in the organic EL display device configured of the writing and scanning circuit 40 or the power supply scanning circuit 50 equipped on the display panel 70 the same as the pixel array unit 30, it is possible to narrow the frame of the display panel 70. Further, in the organic EL display device configured of the writing and scanning circuit 40 or the power supply scanning circuit 50 arranged outside the display panel 70 as the driver IC, it is possible to reduce the size of the driver IC.

5-4. Others

In the organic EL display device described above, the circuit configuration is described as an example in which the circuit is configured of the transistors 22 and 23 of the N channel having two pixels 20 and one retention capacitor 24, however, the pixel 20 is not limited to the circuit configuration described above. In other words, for example, the pixel 20 may be provided in the circuit configuration where the P channel type TFT is used as the driving transistor 22 or the circuit configuration which has an auxiliary capacitor for making up for a shortage of the capacitor of the organic EL element 21 and for increasing the writing gain of the image signal with respect to the retention capacitor 24 which makes up for a shortage of capacitors of the organic EL element 21. Furthermore, the pixel 20 of the circuit configuration, which separately has a switching transistor for selectively writing the reference voltage $V_{ofs}$ or the second power source electric potential $V_{ini}$, may be provided.

In addition, in the application example described above, the electro-optic element of the pixel 20 is described as an example in which the electro-optic element is applied to the organic EL display device using the organic EL element, however, the technology of the present disclosure is not limited to the application example. Specifically, the technology of the present disclosure may be applied to overall display devices having the scanning circuit such as a liquid crystal display device or a plasma display device as well as the display device using the current driving type electro-optic element (the light emitting element) where the light emitting brightness changes according to the current value flowing in the device. Furthermore, the technology of the present disclosure is not limited to the display device and may be applied to overall devices having the scanning circuit such as the solid-state imaging device.

6. Electronic Equipment

The display device, which equips the scanning circuit using the buffer circuit of the present disclosure in the output end, may be used as the display section (the display device) of electronic equipment in all fields displaying as the image, the image signal input in the electronic equipment or the image signal generated in the electronic equipment as the image or the picture.

As clear from the description of each of embodiments described above, the scanning circuit using the level shifter circuit of the present disclosure as the circuit of the preceding stage of the inverter circuit of the final stage may narrow the frame of the display panel, for example, in the display device equipped on the same display panel as the pixel array unit. Accordingly, in the electronic equipment of overall fields having the display section, as the display section thereof, the display device in which the scanning circuit using the level shifter circuit of the present disclosure as the circuit of the preceding stage of the inverter circuit of the final stage and thereby the size of the main body of the electronic equipment may be reduced.

The electronic equipment may include, for example, a mobile information appliance such as a PDA (Personal Digital Assistant), a game console, a notebook type personal computer, an electronic book and mobile communication equipment such as a cellular phone, as well as a television set, a digital camera, a video camera or the like.

7. Configuration of Present Disclosure

The present disclosure may employ the configuration described below.

(1) A level shifter circuit, wherein a first transistor circuit configured of a first conductive type transistor and a second transistor circuit configured of a second conductive type transistor are connected serially between a first fixed power source and a second fixed power source, and a third transistor circuit configured of the first conductive type transistor and a fourth transistor circuit configured of the second conductive type transistor are connected serially between the first fixed power source and the second fixed power source;

wherein a first input voltage is applied to an input terminal of the second transistor circuit and a second input voltage is applied to an input terminal of the fourth transistor circuit;

wherein an input terminal of the first transistor circuit is connected to an output terminal of the third and the fourth transistor circuits, and an input terminal of the third transistor circuit is connected to an output terminal of the first and the second transistor circuits;

wherein two transistor circuits of at least one side of two transistor circuits of a first fixed power source side and two transistor circuits of a second fixed power source side are configured of double gate transistors; and wherein the level shifter circuit has a switch element for applying a voltage of a third fixed power source to a common connection node of the double gate transistor of two transistor circuits of the power source side of the other side when two transistor circuits of the power source side of one side are in an operating state.

(2) The level shifter circuit according to (1), wherein the voltage between the first fixed power source and the third fixed power source, and the voltage between the third fixed power source and the second fixed power source are voltages within a range of a source-drain withstand voltage of each transistor constituting the first to the fourth transistor circuits.

(3) The level shifter circuit according to (1) or (2), wherein the first input voltage and the second input voltage are reverse phased voltages to each other.

(4) The level shifter circuit according to any one of (1) to (3), wherein the voltage of the third fixed power source has a value between voltages of the first fixed power source and the second fixed power source.

(5) The level shifter circuit according to (4), wherein the voltage of the third fixed power source is an average value of respective voltages of the first fixed power source and the second fixed power source.

(6) The level shifter circuit according to any one of (1) to (5), wherein the switch element is transistor having the same conductive type as the transistor constituting two transistor circuits of the power source side of the other side.

(7) The level shifter circuit according to any one of (1) to (6), wherein the switch element the first input voltage or the second input voltage as a gate input.

(8) The level shifter circuit according to any one of (1) to (7), wherein an inverter circuit of the final stage is connected to the common connection node of the third and the fourth transistor circuits.

(9) The level shifter circuit according to any one of (1) to (8), wherein the first fixed power source is a positive side power source and second fixed power source is a negative side power source, and the first conductive type transistor is a P channel type transistor and the second conductive type transistor is an N channel type transistor.

(10) The level shifter circuit according to (9), wherein the voltage of the first fixed power source is higher than the voltage of a high voltage side of the first and the second input voltages, and the voltage of the second fixed power source is lower than or equal to the voltage of a low voltage side of the first and the second input voltages.

(11) The level shifter circuit according to (9), wherein the voltage of the first fixed power source is higher than the voltage of the positive side power source of the inverter circuit of the final stage, and the voltage of the second fixed power source is the same as the voltage of the negative side power source of the inverter circuit of the final stage.

(12) The level shifter circuit according to any one of (1) to (8), wherein the first fixed power source is the negative side power source and the second fixed power source is the positive side power source, and the first conductive type transistor is the N channel type transistor and the second conductive type transistor is the P channel type transistor.

(13) The level shifter circuit according to (12), wherein the voltage of the first fixed power source is lower than the voltage of the low voltage side of the first and the second input voltages, and the voltage of the second fixed power source is higher than or equal to the voltage of the high voltage side of the first and the second input voltages.

(14) The level shifter circuit according to (12), wherein the voltage of the first fixed power source is lower than the voltage of the negative side power source of the inverter circuit of the final stage, and the voltage of the second fixed power source is the same as the voltage of the positive side power source of the inverter circuit of the final stage.

(15) A scanning circuit including:

an inverter circuit in a final stage; and a level shifter circuit in a preceding stage of the inverter circuit, wherein in the level shifter circuit, a first transistor circuit configured of a first conductive type transistor and a second transistor circuit configured of a second conductive type transistor are connected serially between a first fixed power source and a second fixed power source, and a third transistor circuit configured of the first conductive type transistor and a fourth transistor circuit configured of the second conductive type transistor are connected serially between the first fixed power source and the second fixed power source;

wherein a first input voltage is applied to an input terminal of the second transistor circuit and a second input voltage is applied to an input terminal of the fourth transistor circuit;

wherein an input terminal of the first transistor circuit is connected to an output terminal of the third and the fourth transistor circuits, and an input terminal of the third transistor circuit is connected to an output terminal of the first and the second transistor circuits;

wherein two transistor circuits of at least one side of two transistor circuits of a first fixed power source side and two transistor circuits of a second fixed power source side are configured of double gate transistors; and wherein two transistor circuits has a switch element for applying a voltage of a third fixed power source to a common connection node of the double gate transistor of two transistor circuits of the power source side of the other side when two transistor circuits of the power source side of one side are in an operating state.

(16) A display device including:

a pixel array unit where the pixels including an electro-optic element are arranged in a matrix; and a scanning circuit which has an inverter circuit in a final stage and a level shifter circuit in a preceding stage of the inverter circuit, and scans each pixel of the pixel array unit and wherein in the level shifter circuit, a first transistor circuit configured of a first conductive type transistor and a second transistor circuit configured of a second conductive type transistor are connected serially between a first fixed power source and a second fixed power source, and a third transistor circuit configured of the first conductive type transistor and a fourth transistor circuit configured of the second conductive type transistor are connected serially between the first fixed power source and the second fixed power source;

a first input voltage is applied to the second transistor circuit and a second input voltage is applied to the fourth transistor circuit;

an input terminal of the first transistor circuit is connected to an output terminal of the third and the fourth transistor circuits, and an input terminal of the third transistor circuit is connected to an output terminal of the first and the second transistor circuits;

at least one side of two transistor circuits in two transistor circuits of the first fixed power source side and two transistor circuits of the second fixed power source side are configured of a double gate transistor; and a switch element is included for applying a voltage of a third fixed power source to a common connection node of the double gate transistor of two transistor circuits of the power source side of the other side when two transistor circuits of the power source side of one side is in an operating state.

(17) Electronic equipment including:

a display device including:

a pixel array unit where pixels including an electro-optic element are arranged in a matrix; and a scanning circuit which has an inverter circuit in a final stage and a level shifter circuit in a preceding stage of the inverter circuit, and scans each pixel of the pixel array unit and wherein in the level shifter circuit, a first transistor circuit configured of a first conductive type transistor and a second transistor circuit configured of a second conductive type transistor are connected serially between a first fixed power source and a second fixed power source, and a third transistor circuit configured of the first conductive type transistor and a fourth transistor circuit configured of the second conductive type transistor are connected serially between the first fixed power source and the second fixed power source;

wherein a first input voltage is applied to an input terminal of the second transistor circuit and a second input voltage is applied to an input terminal of the fourth transistor circuit;

wherein an input terminal of the first transistor circuit is connected to an output terminal of the third and the fourth transistor circuits, and an input terminal of the third transistor circuit is connected to an output terminal of the first and the second transistor circuits;

wherein two transistor circuits of at least one side of two transistor circuits of a first fixed power source side and two transistor circuits of a second fixed power source side are configured of double gate transistors; and wherein the level shifter circuit has a switch element for applying a voltage of a third fixed power source to a common connection node of the double gate transistor of two transistor circuits of the power source side of the other side when two transistor circuits of the power source side of one side are in an operating state.

The present disclosure contains subject matter related to that disclosed in Japanese Priority Patent Application JP 2011-247141 filed in the Japan Patent Office on Nov. 11, 2011, the entire contents of which are hereby incorporated by reference.

It should be understood by those skilled in the art that various modifications, combinations, sub-combinations and alterations may occur depending on design requirements and other factors insofar as they are within the scope of the appended Claims or the equivalents thereof.

What is claimed is:

1. A circuit for driving an organic EL device, comprising:

a first transistor circuit and a second transistor circuit connected serially between a first fixed power source and a second fixed power source, and a third transistor circuit and a fourth transistor circuit connected serially between the first fixed power source and the second fixed power source, the first fixed power source being at a first fixed power source side and the second fixed power source being at a second fixed power source side, such that the first transistor circuit and the third transistor circuit are on the first fixed power source side and the second transistor circuit and the fourth transistor circuit are on the second fixed power source side, wherein a first input voltage is applied to an input terminal of the second transistor circuit and a second input voltage is applied to an input terminal of the fourth transistor circuit, an input terminal of the first transistor circuit is connected to an output terminal of the third and the fourth transistor circuits, and an input terminal of the third transistor circuit is connected to an output terminal of the first and the second transistor circuits, and wherein at least one of the first and third transistor circuits comprises double gate transistors and at least one of the second and fourth transistor circuits comprises double gate transistors; and a switch element for applying a voltage of a third fixed power source to a common connection node of the double gate transistors at a first side, the first side being one of the first fixed power source side or the second fixed power source side when the transistor circuits at a second side are in an operating state, the second side being the other of the first fixed power source side or the second fixed power source side, and wherein the voltage of the third fixed power source has a value between voltages of the first fixed power source and the second fixed power source.

2. The circuit according to claim 1, wherein the voltage between the first fixed power source and the third fixed power source, and the voltage between the third fixed power source and the second fixed power source are voltages within a range of a source-drain withstand voltage of each transistor constituting the first to the fourth transistor circuits.

3. The circuit according to claim 1, wherein the first input voltage and the second input voltage are reverse phased voltages to each other.

4. The circuit according to claim 1, wherein the voltage of the third fixed power source is an average value of respective voltages of the first fixed power source and the second fixed power source.

5. The circuit according to claim 1, wherein the switch element is a transistor having the same conductive type as the transistor circuits of the second side.

6. The circuit according to claim 1, wherein the first, second, third and fourth transistor circuits respectively comprise double gate transistors.

7. The circuit according to claim 6, wherein the voltage between the first fixed power source and the third fixed power source, and the voltage between the third fixed power source and the second fixed power source are voltages within a range of a source-drain withstand voltage of each transistor constituting the first to the fourth transistor circuits.

8. The circuit according to claim 6, wherein the first input voltage and the second input voltage are reverse phased voltages to each other.

9. The circuit according to claim 6, wherein the voltage of the third fixed power source is an average value of respective voltages of the first fixed power source and the second fixed power source.

10. The circuit according to claim 6, wherein the switch element is a transistor having the same conductive type as the transistor circuits of the second side.

11. A display device comprising a pixel area unit and the circuit according to claim 1.

12. The display device according to claim 11, wherein the voltage between the first fixed power source and the third fixed power source, and the voltage between the third fixed power source and the second fixed power source are voltages within a range of a source-drain withstand voltage of each transistor constituting the first to the fourth transistor circuits.

13. The display device according to claim 11, wherein the first input voltage and the second input voltage are reverse phased voltages to each other.

14. The display device according to claim 11, wherein the voltage of the third fixed power source is an average value of respective voltages of the first fixed power source and the second fixed power source.

15. The display device according to claim 11, wherein the switch element is a transistor having the same conductive type as the transistor circuits of the second side.

16. The display device according to claim 11, wherein the first, second, third and fourth transistor circuits respectively comprise double gate transistors.

17. The display device according to claim 16, wherein the voltage between the first fixed power source and the third fixed power source, and the voltage between the third fixed power source and the second fixed power source are voltages within a range of a source-drain withstand voltage of each transistor constituting the first to the fourth transistor circuits.

18. The display device according to claim 16, wherein the first input voltage and the second input voltage are reverse phased voltages to each other.

19. The display device according to claim 16, wherein the voltage of the third fixed power source is an average value of respective voltages of the first fixed power source and the second fixed power source.

20. The display device according to claim 16, wherein the switch element is a transistor having the same conductive type as the transistor circuits of the second side.

* * * * *